US008047885B2

(12) United States Patent
Nakamura et al.

(10) Patent No.: US 8,047,885 B2
(45) Date of Patent: Nov. 1, 2011

(54) BOAT PROPULSION UNIT

(75) Inventors: Daisuke Nakamura, Shizuoka (JP); Yoshihiko Okabe, Shizuoka (JP); Yoshihito Fukuoka, Shizuoka (JP); Masami Suzuki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 192 days.

(21) Appl. No.: 12/468,121

(22) Filed: May 19, 2009

(65) Prior Publication Data

US 2009/0298361 A1 Dec. 3, 2009

(30) Foreign Application Priority Data

May 27, 2008 (JP) ..... 2008-137358
Jan. 19, 2009 (JP) ..... 2009-008425

(51) Int. Cl.
*B63H 20/14* (2006.01)

(52) U.S. Cl. ..... 440/75; 440/80

(58) Field of Classification Search ..... 440/75, 440/80, 81; 475/312, 314, 315
See application file for complete search history.

(56) References Cited

U.S. PATENT DOCUMENTS 5,601,464 A * 2/1997 Ogino et al. ..... 440/75
6,623,320 B1 * 9/2003 Hedlund ..... 440/80
2008/0233815 A1 9/2008 Nakamura et al.

FOREIGN PATENT DOCUMENTS

WO 2007/007707 A1 1/2007

* cited by examiner

*Primary Examiner* — Lars A Olson
(74) *Attorney, Agent, or Firm* — Keating & Bennett, LLP

(57) ABSTRACT

A boat propulsion unit has a construction that prevents a structure near a drive shaft from becoming complicated and increased in size. The boat propulsion unit preferably in the form of an outboard motor includes a front propeller that is rotated together with a front propeller drive shaft during both forward travel and reverse travel of the boat, a rear propeller that is rotated together with a rear propeller drive shaft in an opposite direction of the front propeller during both of the forward travel and the reverse travel of the boat, and a forward-reverse drive that is arranged on an axis of the front propeller drive shaft and the rear propeller drive shaft, and that can be switched between a direction in which the front propeller drive shaft and the rear propeller drive shaft are rotated during the forward travel of the boat and a direction in which the front propeller drive shaft and the rear propeller drive shaft are rotated during the reverse travel of the boat.

17 Claims, 17 Drawing Sheets

BOAT PROPULSION UNIT

BACKGROUND OF THE INVENTION

1. Field of the Invention

The present invention relates to a boat propulsion unit, and more specifically, to a boat propulsion unit that includes a first propeller and a second propeller.

2. Description of the Related Art

A boat propulsion device (boat propulsion unit) that includes a first propeller and a second propeller is conventionally known (see WO 2007/007707 A1, for example). WO 2007/007707 A1 discloses a boat propulsion unit including: a drive shaft; a first shaft that extends in the fore-and-aft direction perpendicular or substantially perpendicular to the drive shaft, and that is provided with a front propeller (first propeller) at the rear end; a second shaft that extends in the fore-and-aft direction perpendicular or substantially perpendicular to the drive shaft, and that is provided with a rear propeller (second propeller) at the rear end; a forward-reverse switching mechanism that is arranged on the drive shaft, and that can be switched between the direction in which the first shaft and the second shaft are rotated and the direction in which the second shaft is rotated. The forward-reverse switching mechanism for the boat propulsion unit according to WO 2007/007707 A1 described above is constituted with two wet-type multi-plate clutch driven by hydraulic pressure and a planetary gear mechanism. The forward-reverse switching mechanism is constructed in a manner that the first shaft is rotated in a first direction and the second shaft is rotated in a second direction when the boat travels forward, and that the first shaft is rotated in the second direction and the second shaft is rotated in the first direction when the boat travels in reverse.

However, in the boat propulsion device (boat propulsion unit) disclosed in WO 2007/007707 A1, in addition to the two wet-type multi-plate clutch, the planetary gear mechanism is arranged in the forward-reverse switching mechanism arranged on the drive shaft. Thus, there is a problem in that the structure near the drive shaft is complicated and increased in size.

SUMMARY OF THE INVENTION

In order to overcome the problems described above, preferred embodiments of the present invention provide a boat propulsion unit that can prevent the structure near the drive shaft from being complicated and increased in size.

A boat propulsion unit according to a preferred embodiment of the present invention includes an engine; a drive shaft that extends below the engine; a first shaft and a second shaft that extend in a direction intersecting with the drive shaft; a first propeller that is disposed on the first shaft and that is rotated together with the first shaft during both of forward travel and reverse travel of the boat; a second propeller that is disposed on the second shaft and that is rotated together with the second shaft in the opposite direction of the first propeller during both of the forward travel and reverse travel of the boat; and a forward-reverse switching mechanism that is arranged on an axis of the first shaft and the second shaft and that can switch between the direction in which the first shaft and the second shaft are rotated when the boat is advanced and the direction in which the first shaft and the second shaft are rotated when the boat is reversed.

In the boat propulsion unit according to the preferred embodiment of the present invention described above, the forward-reverse switching mechanism, which can switch between the direction in which the first shaft and the second shaft are rotated during the forward travel of the boat and the direction in which the first shaft and the second shaft are rotated during the reverse travel of the boat, is disposed on the axis of the first shaft and the second shaft. Since the forward-reverse switching mechanism is not arranged near the drive shaft, the structure near the drive shaft can be prevented from becoming complicated and increased in size.

In the boat propulsion unit according to the preferred embodiment described above, preferably, the forward-reverse switching mechanism includes a forward-reverse drive that is driven during both of the forward travel and the reverse travel of the boat; and a reverse drive that is driven during the reverse travel of the boat. According to this construction, the reverse drive is not driven when the boat is propelled forward. Thus, output loss of the engine during the forward travel of the boat can be reduced since the reverse drive is not driven when the boat is propelled forward.

Preferably, in the boat propulsion unit including the forward-reverse switching mechanism in which the forward-reverse drive and the reverse drive are disposed, the forward-reverse drive of the forward-reverse switching mechanism preferably includes: a first clutch that is engaged when the boat is advanced or reversed and that transmits the driving force of the engine to the first shaft; a second clutch that is engaged when the boat is advanced or reversed and that transmits the driving force of the engine to the second shaft; and a third clutch that is engaged when the boat is reversed and that transmits the driving force of the engine to the reverse drive. Since the forward-reverse drive of the forward-reverse switching mechanism is provided with the first clutch that is engaged during the forward travel and reverse travel of the boat and that transmits the driving force of the engine to the first shaft, driving force of the engine can easily be connected with or disconnected from the first shaft. Also, driving force of the engine can easily be connected with or disconnected from the reverse drive and the second shaft since the forward-reverse drive of the forward-reverse switching mechanism is provided with the second clutch that is engaged when the boat is advanced or reversed and that transmits the driving force of the engine to the second shaft, and a third clutch that is engaged when the boat is reversed and that transmits the driving force of the engine to the reverse drive.

Preferably, the boat propulsion unit that is provided with the first clutch, the second clutch, and the third clutch includes a drive gear that is disposed below the drive shaft; a first bevel gear that is meshed with the drive gear and that is rotated in the first direction along with the rotation of the drive gear; a second bevel gear that is meshed with the drive gear and that is rotated in the second direction, which is the opposite of the first direction, along with the rotation of the drive gear. When the boat is propelled forward, the first bevel gear is engaged with the first shaft by the first clutch to rotate the first shaft in the first direction, and the second bevel gear is engaged with the second shaft by the second clutch to rotate the second shaft in the second direction. According to this construction, when the boat is propelled forward, the first shaft can easily be rotated in the first direction by the first clutch, and the second shaft can easily be rotated in the second direction by the second clutch.

In the boat propulsion unit in which the first shaft is rotated in the first direction and the second shaft is rotated in the second direction when the boat is propelled forward, preferably, when the boat is propelled in reverse, the second bevel gear is engaged with the first shaft by the first clutch to rotate the first shaft in the second direction, and the second bevel gear is engaged with the reverse drive by the third clutch and the reverse drive is engaged with the second shaft by the second clutch to rotate the second shaft in the first direction. According to this construction, when the boat is propelled in reverse, the first shaft can easily be rotated in the second direction by the first clutch, and the second shaft can easily be rotated in the first direction by the second clutch and the third clutch.

In the boat propulsion unit in which the first shaft is rotated in the second direction and the second shaft is rotated in the first direction during the reverse travel of the boat, preferably, the reverse drive includes: an input portion that is engaged with the second bevel gear via the third clutch and that is rotated in the second direction, which is the same rotational direction as the second bevel gear, when the boat is propelled in reverse; and an output portion that is engaged with the second shaft via the second clutch and that is rotated in the first direction, which is the opposite rotational direction of the second bevel gear, when the water craft is propelled in reverse. According to this construction, the rotation of the second bevel gear in the second direction, which is input from the input portion, can be output from the output portion in a state that the rotational direction is converted to the first direction, which is the opposite rotational direction of the second bevel gear.

In the boat propulsion unit provided with the reverse drive that has the input portion and the output portion, preferably, the reverse drive is constructed such that the output portion is rotated in the first direction which is the opposite rotational direction of the second bevel gear that is input to the input portion by combination of a plurality of bevel gears. According to this construction, a rotational direction of the second bevel gear can easily be transmitted to the second shaft in a converted state.

In the boat propulsion unit provided with the reverse drive constructed with the plurality of bevel gears, preferably, the reverse drive includes a third bevel gear that constitutes the input portion with which the third clutch is engaged and that is rotated in the second direction which is the same rotational direction as the second bevel gear; a fourth bevel gear that is meshed with the third bevel gear and that is rotated in an opposite rotational direction of the drive shaft; a fifth bevel gear that is meshed with the fourth bevel gear and that is rotated in the first direction which is an opposite rotational direction of the third bevel gear; and an output shaft that is provided with the fifth bevel gear, and that constitutes the output portion with which the second clutch is engaged, and that is rotated in the first direction together with the fifth bevel gear. According to this construction, the second rotational direction, which is the rotational direction of the second bevel gear, can easily be converted to the opposite direction. Accordingly, the second shaft can easily be rotated in the first direction.

In the boat propulsion unit provided with the reverse drive that has the input portion and the output portion, preferably, the reverse drive is constructed such that the output portion is rotated in the first direction which is the opposite rotational direction of the second bevel gear that is input to the input portion by using a planetary gear mechanism. According to this construction, a rotational direction of the second bevel gear can easily be transmitted to the second shaft in a converted state.

The boat propulsion unit that is provided with the first clutch, the second clutch, and the third clutch, preferably, further includes one forward-reverse switching lever that is shifted to be engaged with or disengaged from the first clutch, the second clutch, and the third clutch. According to this construction, switching between the forward travel and the reverse travel of the boat can easily be performed by the one forward-reverse switching lever.

In the boat propulsion unit that includes the forward-reverse switching mechanism provided with the forward-reverse drive and the reverse drive, preferably, the second propeller is disposed on one side of the second shaft, and the reverse drive is arranged on the other side of the second shaft. According to this construction, a space on the other side of the first shaft and the second shaft of the boat propulsion unit can be used effectively.

In the boat propulsion unit that includes the forward-reverse switching mechanism provided with the forward-reverse drive and the reverse drive, preferably, the driving force of the engine is not transmitted to the reverse drive when the boat is propelled forward. According to this construction, the reverse drive is not driven when the boat is propelled forward. Thus, output loss of the engine during the forward travel of the boat can be reduced since the reverse drive is not driven when the boat is propelled forward.

Preferably, in the boat propulsion unit including the forward-reverse switching mechanism provided with the forward-reverse drive and the reverse drive, the forward-reverse drive of the forward-reverse switching mechanism includes: a fourth clutch that is engaged during the forward travel and reverse travel of the boat and that transmits the driving force of the engine to the second shaft; a fifth clutch that is engaged during the forward travel and reverse travel of the boat and that transmits driving force of the engine to the first shaft; and a sixth clutch that is engaged during the reverse travel of the boat and that transmits driving force of the engine to the reverse drive. Since the forward-reverse drive of the forward-reverse switching mechanism is provided with the fourth clutch that is engaged when the boat is advanced or reversed and that transmits the driving force of the engine to the second shaft, the driving force of the engine can easily be connected with or disconnected from the second shaft. Also, driving force of the engine can easily be connected with or disconnected from the reverse drive and the first shaft since the forward-reverse drive of the forward-reverse switching mechanism is provided with the fifth clutch that is engaged when the boat is advanced or reversed and that transmits the driving force of the engine to the first shaft, and the sixth clutch that is engaged when the boat is reversed, and that transmits the driving force of the engine to the reverse drive.

Preferably, the boat propulsion unit that is provided with the fourth clutch, the fifth clutch, and the sixth clutch further includes: a drive gear that is disposed below the drive shaft; a first bevel gear that is meshed with the drive gear and that is rotated in the first direction along with the rotation of the drive gear; a second bevel gear that is meshed with the drive gear and that is rotated in the second direction, which is the opposite of the first direction, along with the rotation of the drive gear. The second bevel gear and the second shaft are engaged by the fourth clutch to rotate the second shaft in the second direction when the boat is propelled forward. The first bevel gear and the first shaft are engaged by the fifth clutch to rotate the first shaft in the first direction when the boat is propelled forward. According to this construction, when the boat is propelled forward, the second shaft can easily be rotated in the second direction by the fourth clutch, and the first shaft can easily be rotated in the first direction by the fifth clutch.

In this case, preferably, when the boat is propelled in reverse, the first bevel gear is engaged with the second shaft by the fourth clutch to rotate the second shaft in the first direction, the first bevel gear is engaged with the reverse drive by the sixth clutch, and the reverse drive is engaged with the first shaft by the fifth clutch to rotate the first shaft in the second direction. According to this construction, when the boat is propelled in reverse, the second shaft can easily be rotated in the first direction by the fourth clutch, and the first shaft can easily be rotated in the second direction by the fifth clutch and the sixth clutch.

Other features, elements, arrangements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, a description will be made of preferred embodiments of the present invention with reference to the drawings.

First Preferred Embodiment

Figure 1:
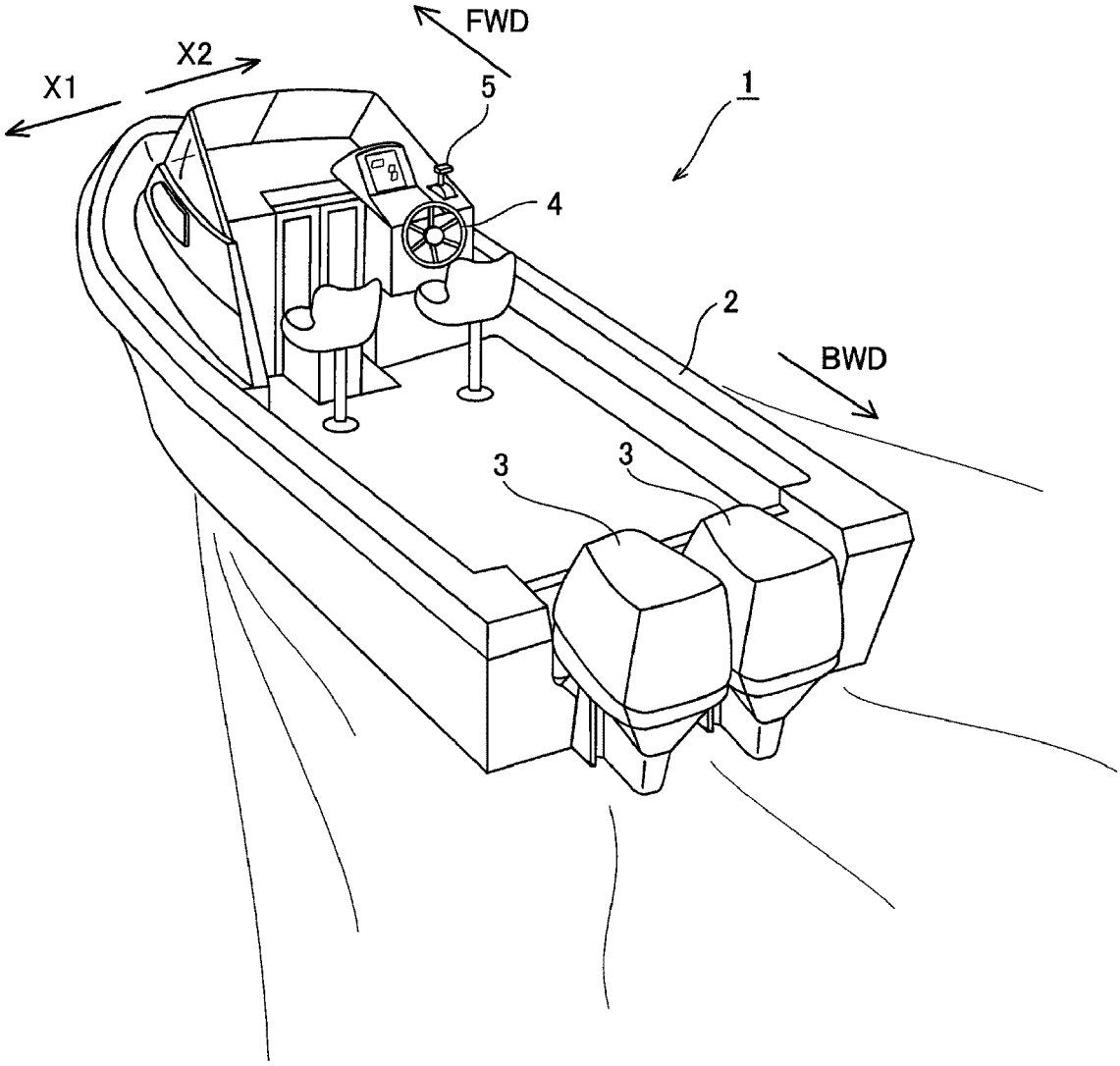
FIG. 1 is a perspective view showing a boat in which an outboard motor in accordance with a first preferred embodiment of the present invention is installed.

FIG. 1 is a perspective view showing a boat in which an outboard motor in accordance with a first preferred embodiment of the present invention is installed. FIG. 2 through FIG. 9 are drawings for specifically illustrating a construction of the outboard motor in accordance with the first preferred embodiment shown in FIG. 1. In the drawings, FWD denotes the forward direction of the boat while BWD denotes the backward direction of the boat. First, construction of an outboard motor 3 that is installed in the boat 1 in accordance with the first preferred embodiment is described with reference to FIG. 1 through FIG. 9.

As shown in FIG. 1, the boat 1 in accordance with the first preferred embodiment has a hull 2 to be floated on water, preferably two outboard motors 3 that are mounted on a rear portion of the hull 2 to propel the hull 2, a steering section 4 for steering the hull 2, a control lever 5 disposed in the vicinity of the steering section 4 and capable of turning the hull 2 in the fore-and-aft direction. The outboard motor 3 is an example of the "boat propulsion unit" according to a preferred embodiment of the present invention.

Figure 2:
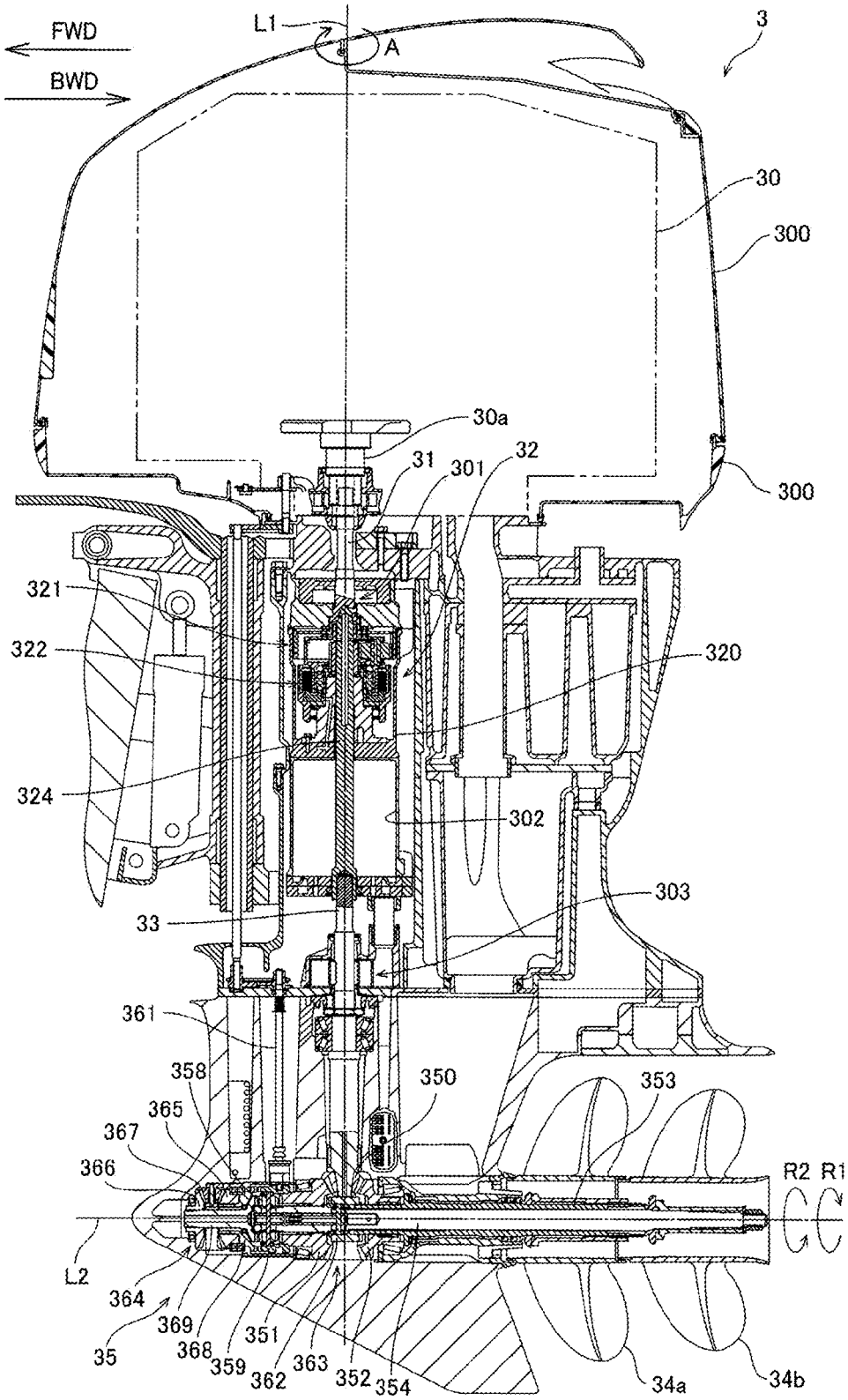
FIG. 2 is a cross-sectional view for explaining the construction of the outboard motor according to the first preferred embodiment shown in FIG. 1.

The two outboard motors 3 preferably are disposed symmetrically with respect to the center in the width direction of the hull 2 (in the arrow X1 direction and the arrow X2 direction). As shown in FIG. 2, the outboard motor 3 includes: an engine 30; an upper drive shaft 31 that is arranged to extend below the engine 30 and that transmits the driving force of the engine 30; a transmission mechanism 32 that changes the driving force of engine 30 transmitted to the upper drive shaft 31 with a low speed reduction ratio (about 1.3:1.0) or a high speed reduction ratio (about 1.0:1.0). The outboard motor 3 further includes: a lower drive shaft 33 that is arranged to extend below the transmission mechanism 32 (engine 30) and that transmits the driving force of the engine 30 in a state that the rotational speed thereof is changed by the transmission mechanism 32; and a lower mechanism 35 that transmits the driving force of the engine 30 received by the lower drive shaft 33 to a front propeller 34*a* and a rear propeller 34*b*. The upper drive shaft 31 and the lower drive shaft 33 are examples of the "drive shaft" in a preferred embodiment of the present invention. The front propeller 34*a* is an example of the "first propeller" in a preferred embodiment of the present invention, and the rear propeller 34*b* is an example of the "second propeller" in a preferred embodiment of the present invention. The outboard motor 3 is covered by a plurality of casings 300. The casings 300 are preferably formed of resin or metal and have a function to protect the inside of the outboard motor 3 against water and so forth.

Now, description will be made of the constructions of the engine 30, the transmission mechanism 32, and so on. The engine 30 is provided with a crankshaft 30*a* that rotates about an axis L1. The engine 30 generates driving force by the rotation of the crankshaft 30*a*. An upper portion of an upper drive shaft 31 is connected to the crankshaft 30*a*. The upper transmission shaft 31 is arranged on the axis L1 and rotates about the axis L1 in the A direction in accordance with the rotation of the crankshaft 30*a* in the A direction.

An oil pump 301 is attached to the vicinity of the bottom of the upper drive shaft 31. The oil pump 301 pumps up the oil reserved in an oil pan 302, which is described below, and applies pressure to the oil in order to supply the pumped-up oil to certain portions in the outboard motor 3.

Figure 3:
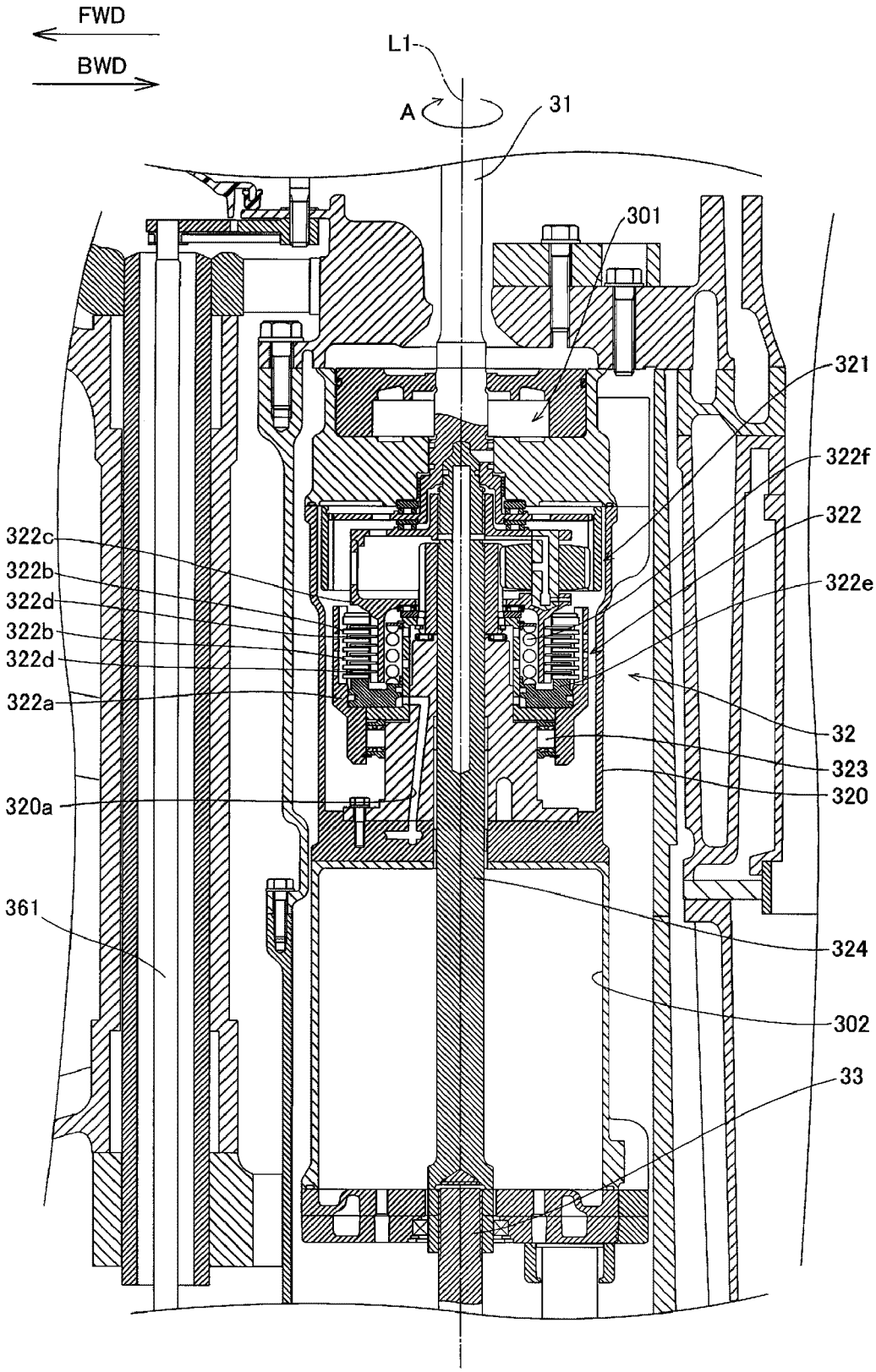
FIG. 3 is a cross-sectional view for explaining the construction of a transmission mechanism of the outboard motor according to the first preferred embodiment shown in FIG. 1.

A lower portion of the upper drive shaft 31 is connected to the transmission mechanism 32. As shown in FIG. 3, the transmission mechanism 32 is housed in a housing 320 and includes: a planetary gear set 321 that can reduce driving force of the upper drive shaft 31; a clutch 322 and a one way clutch 323 that control the rotation of the planetary gear set 321; and an intermediate shaft 324 to which driving force of the upper drive shaft 31 is transmitted via the planetary gear set 321. The transmission mechanism 32 is constructed in a manner such that the intermediate shaft 324 rotates at a rotational speed that is not reduced substantially with respect to the rotational speed of the upper transmission shaft 31 when the clutch 322 is engaged. On the other hand, the transmission mechanism 32 is constructed in a manner that the rotational speed of the intermediate shaft 324 is reduced to be lower than the rotational speed of the upper drive shaft 31 by the rotation of the planetary gear set 321 when the clutch 322 is disengaged.

The clutch 322 is preferably constructed with a wet-type multi-plate clutch. The clutch 322 preferably includes: an outer case 322*a* that is supported by a one-way clutch 323 so as to be rotatable only in the A direction; a plurality of clutch plates 322*b* that is arranged in an inner edge portion of the outer case 322*a* with a certain gap in between; an inner case 322*c* that is at least partially arranged inside the outer case 322*a*; and a plurality of clutch plates 322*d* that are attached to the inner case 322*c* and that are arranged between the plurality of clutch plates 322*b*. When the clutch plates 322*b* of the outer case 322*a* and the clutch plates 322*d* of the inner case 322*c* are in contact with each other, the clutch 322 becomes engaged, and the outer case 322*a* and the inner case 322*c* rotate integrally. On the other hand, when the clutch plate 322*b* of the outer case 322*a* and the clutch plates 322*d* of the inner case 322*c* are separated from each other, the clutch 322 becomes disengaged, and the outer case 322*a* and the inner case 322*c* do not rotate integrally.

Specifically, a piston 322*e* that is slidable on an inner surface of the outer case 322*a* is arranged in the outer case 322*a*. When the piston 322*e* is slid on the inner surface of the outer case 322*a*, the piston 322*e* moves the plurality of clutch plates 322*b* of the outer case 322*a* in the sliding direction of the piston 322*e*. A compression coil spring 322*f* is arranged in the outer case 322*a*. The compression coil spring 322*f* is arranged to urge the piston 322*e* in the direction in which the clutch plates 322*b* of the outer case 322*a* are separated from the clutch plates 322*d* of the inner case 322*c*. When pressure of oil flowing through an oil passage 320*a* in a housing 320 is increased, the piston 322*e* is slid relative to the inner surface of the outer case 322*a* against the reaction force of the compression coil spring 322*f*. An increase and decrease in the pressure of oil flowing through the oil passage 320*a* in the housing 320 as described above can cause the clutch plates 322*b* of the outer case 322*a* and the clutch plates 322*d* of the inner case 322*c* to contact with and separate from each other, which enables the clutch 322 to be engaged or disengaged.

An oil pan 302 is disposed below the transmission mechanism 32. Oil, which is supplied to the transmission mechanism 32 and so forth by the oil pump 301, is stored in the oil pan 302. As shown in FIG. 2, a water pump 303 that is driven in accordance with the rotation of the lower drive shaft 33 is disposed below the oil pan 302. The water pump 303 has a function to pump up water (cooling water) from water surface and to send the pumped-up water to the oil pan 302 and the engine 30.

Now, construction of the lower mechanism 35 that is disposed below the water pump 303 is described.

Figure 5:
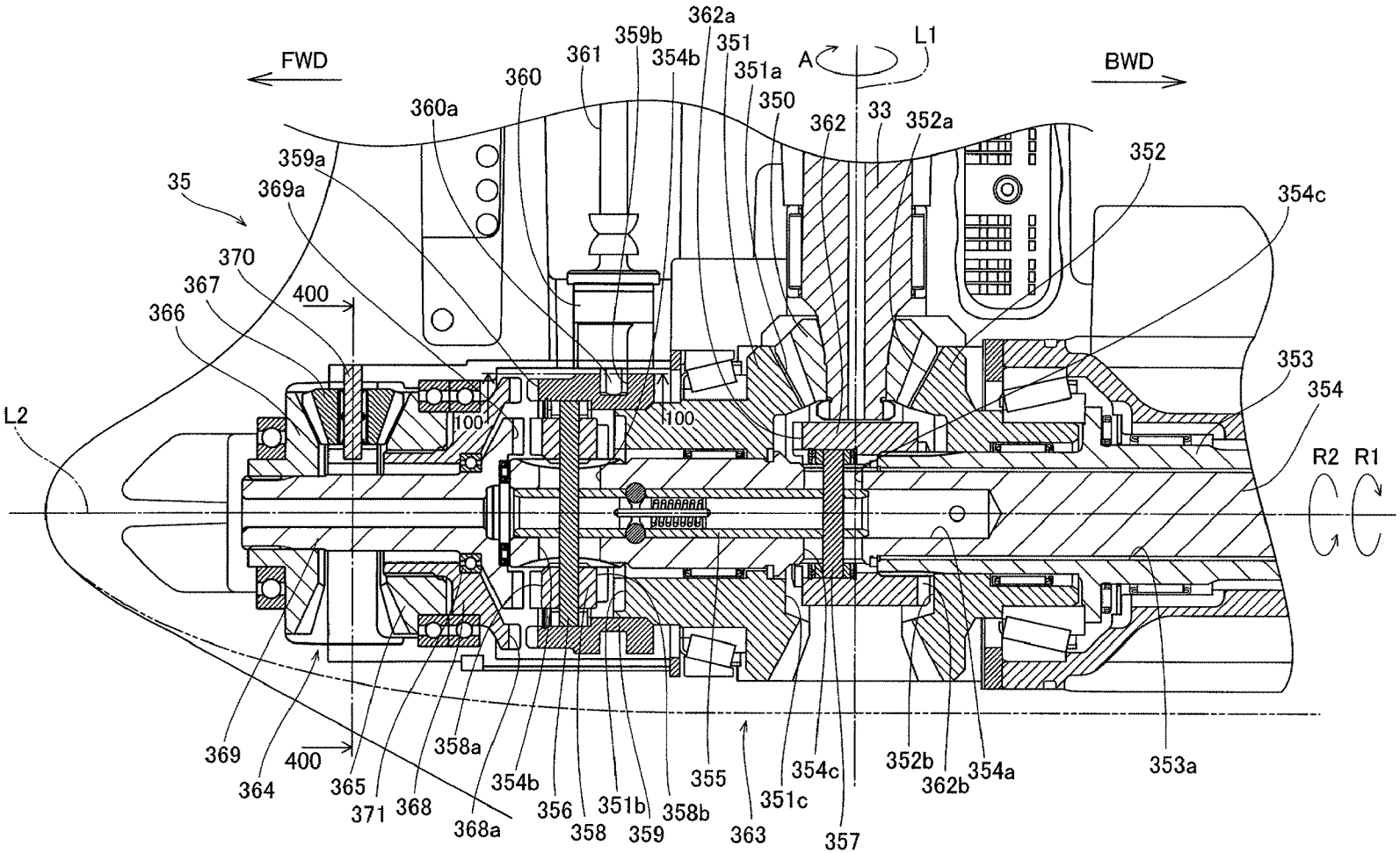
FIG. 5 is a cross-sectional view for explaining the construction of the lower mechanism of the outboard motor according to the first preferred embodiment shown in FIG. 1.

As shown in FIG. 5, a lower portion of the lower drive shaft 33 is arranged in the lower mechanism 35. A bevel gear 350 is attached to the vicinity of a lower end portion (to the bottom) of the lower drive shaft 33. The bevel gear 350 is an example of the "drive gear" in a preferred embodiment of the present invention. The bevel gear 350 is meshed with a gear 351*a* of a front bevel gear 351 arranged below in the arrow FWD direction, and also meshed with a gear 352*a* of a rear bevel gear 352 arranged below in the arrow BWD direction. The front bevel gear 351 is an example of the "second bevel gear" in a preferred embodiment of the present invention, and the rear bevel gear 352 is an example of the "first bevel gear" in a preferred embodiment of the present invention. An axis L2 around which the front bevel gear 351 and the rear bevel gear 352 rotate is perpendicular or substantially perpendicular to the axis L1 around which the bevel gear 350 rotates, and extends in the arrow FWD direction.

A dog 351*b*, which can be engaged with or disengaged from a dog clutch 358 described below, is disposed in an end portion of the front bevel gear 351 in the arrow FWD direction. A dog clutch 359 described below is engaged with an outer edge of the front bevel gear 351 in the arrow FWD direction in a way that the dog clutch 359 can be slid in the fore-and-aft direction. A dog 351*c*, which can be engaged with or disengaged from a dog clutch 362 described below, is disposed in a portion on the arrow BWD side of the front bevel gear 351 and on the axis L2 side of the gear 351*a*. A dog 352*b*, which can be engaged with or disengaged from a dog clutch 362 described below, is disposed in a portion on the arrow FWD side of the rear bevel gear 352 and on the axis L2 side of the gear 352*a*.

Figure 4:
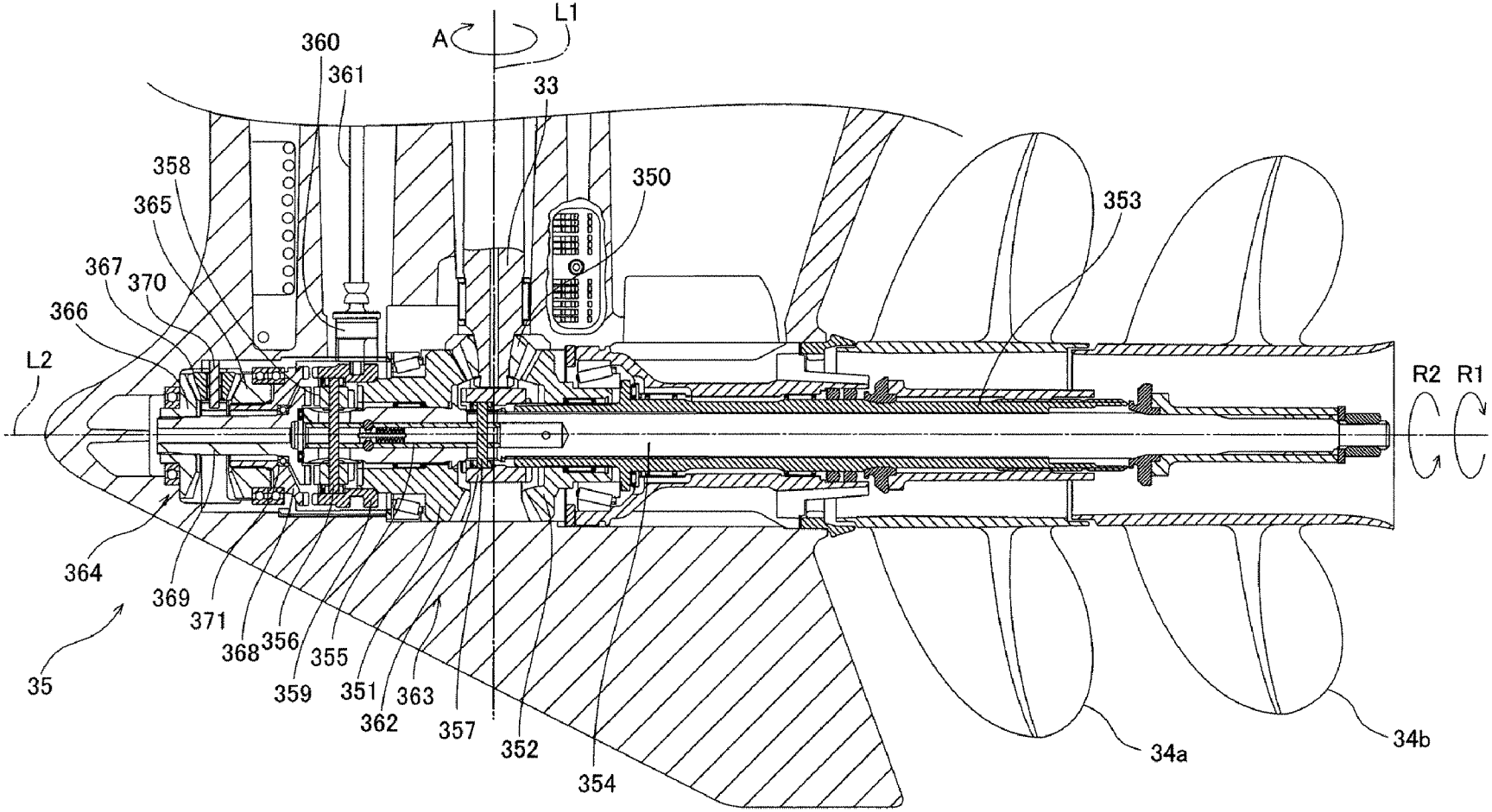
FIG. 4 is a cross-sectional view for explaining the construction of a lower mechanism of the outboard motor according to the first preferred embodiment shown in FIG. 1.

In the first preferred embodiment, a front propeller drive shaft 353 and a rear propeller drive shaft 354, which extend in a direction perpendicular or substantially perpendicular to the lower drive shaft 33, are disposed below the lower drive shaft 33. The front propeller drive shaft 353 is an example of the "first shaft" in a preferred embodiment of the present invention, and the rear propeller drive shaft 354 is an example of the "second shaft" in a preferred embodiment of the present invention. The front propeller drive shaft 353 and the rear propeller drive shaft 354 are constructed to be rotatable in a different direction from each other. The front propeller drive shaft 353 is arranged to rotate about the axis L2, and is formed in the hollow (cylindrical) shape along the axis L2. As shown in FIG. 4, on the arrow BWD side (one side) of the front propeller drive shaft 353, the front propeller 34*a* is attached to be rotatable together with the front propeller drive shaft 353. On the arrow FWD side (another side) of the front propeller drive shaft 353, the rear bevel gear 352 is arranged to be idled with respect to the front propeller drive shaft 353. As shown in FIG. 5, on the periphery of the arrow FWD side where the rear bevel gear 352 of the front propeller drive shaft 353 is arranged, the dog clutch 362 described below is engaged to be slidable in the fore-and-aft direction.

In the first preferred embodiment, the rear propeller drive shaft 354 is inserted in a hollow portion 353*a* along the axis L2 of the front propeller drive shaft 353. In the same way as the front propeller drive shaft 354, the rear propeller drive shaft 353 is arranged to rotate about the axis L2. As shown in FIG. 2, the rear propeller drive shaft 354 is longer than the front propeller drive shaft 353 in the fore-and-aft direction.

An end portion of the rear propeller drive shaft 354 in the arrow FWD direction is arranged to protrude in the arrow FWD direction from an end portion of the front propeller drive shaft 353 on the arrow FWD side. Also, an end portion of the rear propeller drive shaft 354 in the arrow BWD direction is arranged to protrude in the arrow BWD direction from an end portion of the front propeller drive shaft 353 on the arrow BWD side. On the arrow BWD side (one side) of the rear propeller drive shaft 354, the rear propeller 34*b* described above is attached to be rotatable together with the rear propeller drive shaft 354. On the arrow FWD side (another side) of the rear propeller drive shaft 354, the front bevel gear 351 is arranged to be idled with respect to the rear propeller drive shaft 354. As shown in FIG. 5, on the periphery of a portion of the rear propeller drive shaft 354 on the arrow FWD side (another side) where the front bevel gear 351 of the rear propeller drive shaft 354 is arranged, the dog clutch 358 described below is spline-fitted to be slidable in the fore-and-aft direction.

An insertion hole 354*a* along the axis L2 is formed on the arrow FWD side of the rear propeller drive shaft 354. A through hole 354*b* perpendicular or substantially perpendicular to the insertion hole 354*a* is formed in an outer surface near an end portion of the rear propeller drive shaft 354 on the arrow FWD side. Also, a through hole 354*c* perpendicular or substantially perpendicular to the insertion hole 354*a* is formed in an outer surface near an end portion of the front propeller drive shaft 353 of the rear propeller drive shaft 354 on the arrow FWD side. The through holes 354*b* and 354*c* preferably have a slot shape that extends in the fore-and-aft direction (in the arrow FWD direction and arrow BWD direction).

In the insertion hole 354*a* along the axis L2 of the rear propeller drive shaft 354, a connecting member 355 in the shape of a cylinder is inserted to be slidable in the fore-and-aft direction (in the arrow FWD direction and arrow BWD direction). To a portion that corresponds to the through hole 354*b* of the connecting member 355, the connecting member 356 in a rod shape is attached so as to be perpendicular or substantially perpendicular to the connecting member 355. The connecting member 356 is arranged to protrude outside from an outer surface of the rear propeller drive shaft 354. The connecting member 356 is slid along the slot-shaped through hole 354*b* in the fore-and-aft direction when the connecting member 355 is slid along the insertion hole 354*a*. To a portion corresponding to the through hole 354*c* of the connecting member 355, the connecting member 357 in a rod shape is attached to be perpendicular or substantially perpendicular to the connecting member 355. The connecting member 357 is arranged so as to protrude outside from an outer surface of the rear propeller drive shaft 354. The connecting member 357 is slid with respect to the slot-shaped through hole 354*c* in the fore-and-aft direction when the connecting member 355 is slid along the insertion hole 354*a*.

Here, in the first preferred embodiment, a dog clutch 358 and a dog clutch 359 are fixed to the connecting member 356. The dog clutch 358 is an example of the "second clutch" in a preferred embodiment of the present invention, and the dog clutch 359 is an example of the "third clutch" in a preferred embodiment of the present invention.

Figure 6:
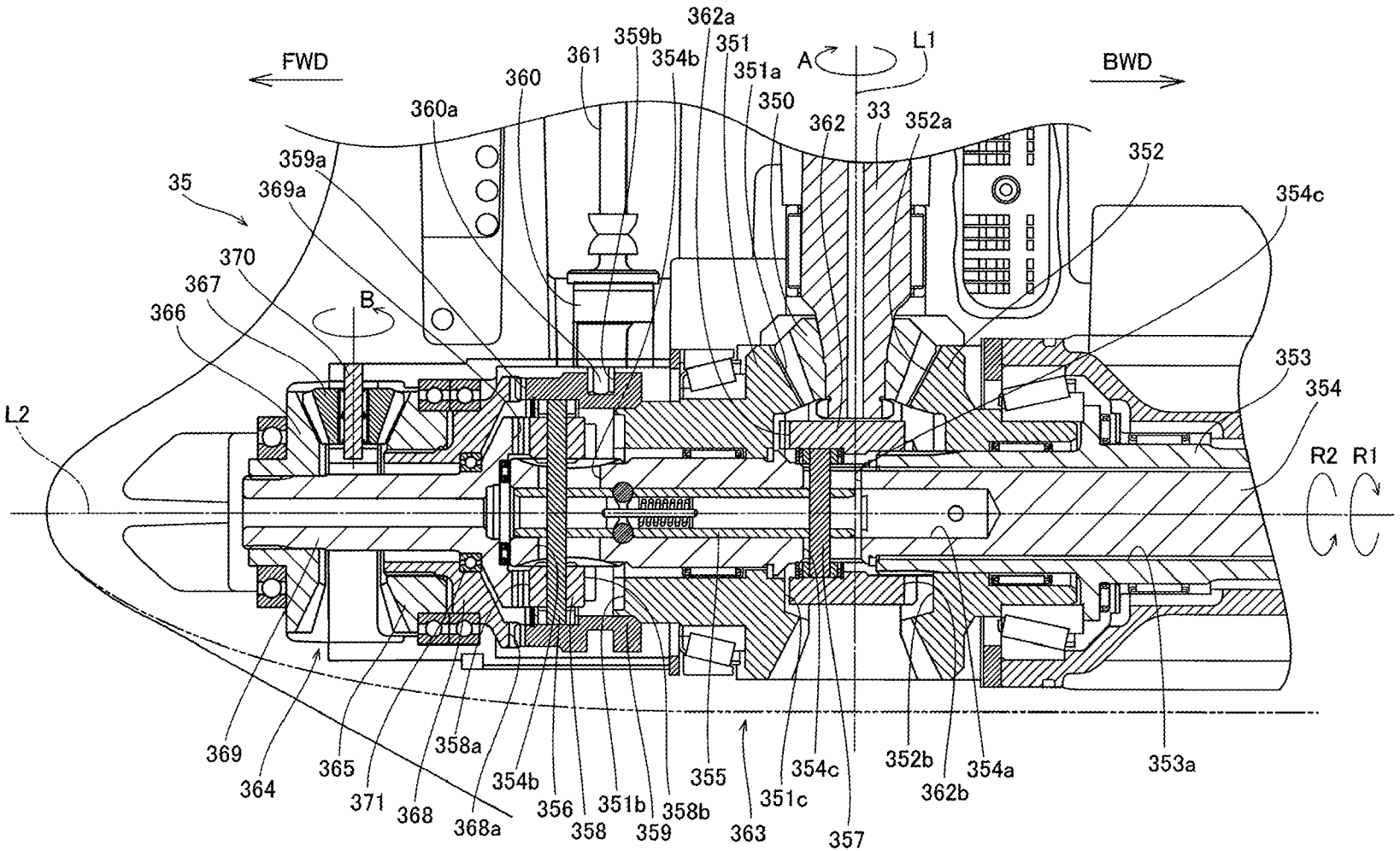
FIG. 6 is a cross-sectional view for explaining the construction of the lower mechanism of the outboard motor according to the first preferred embodiment shown in FIG. 1.
Figure 7:
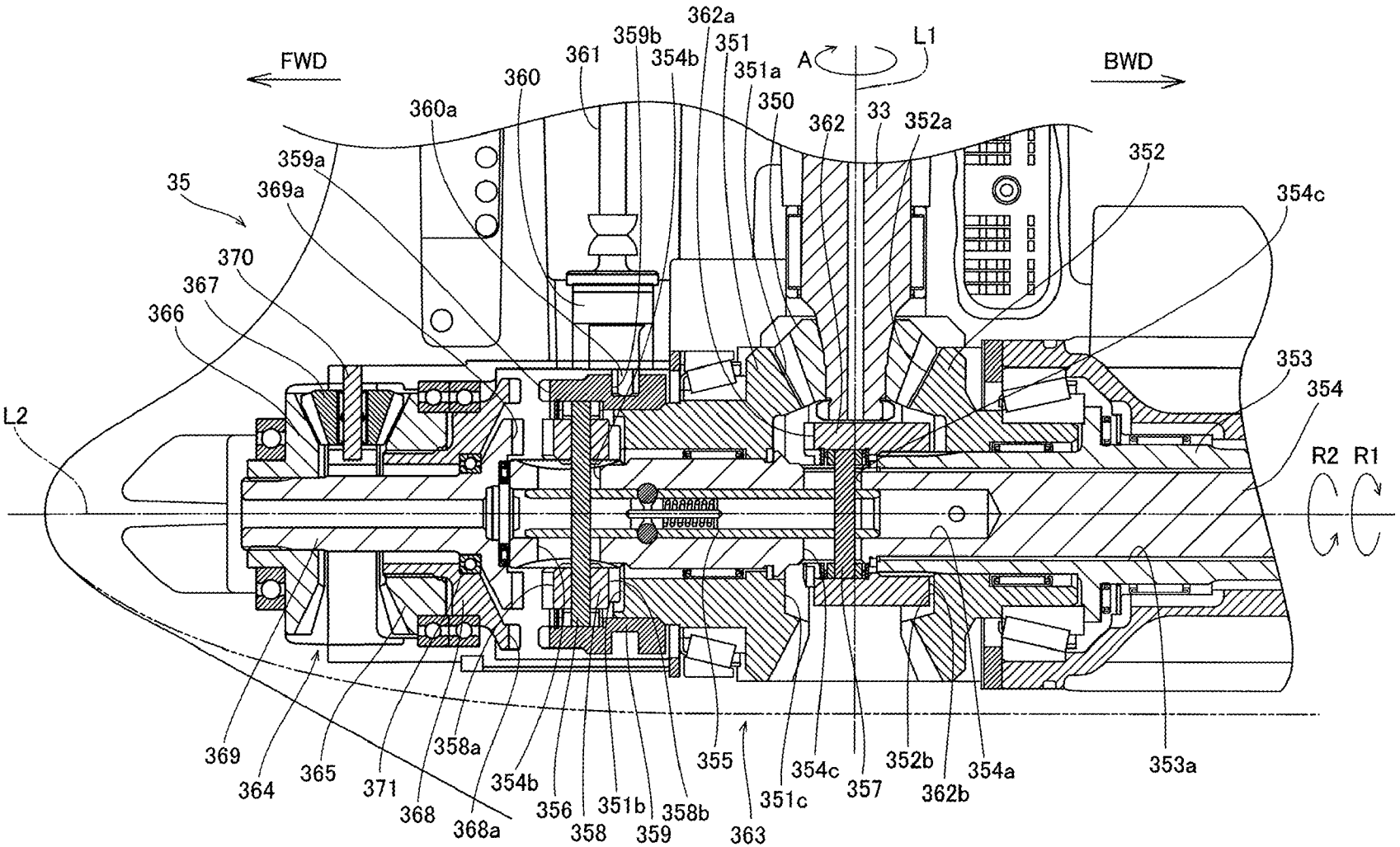
FIG. 7 is a cross-sectional view for explaining the construction of the lower mechanism of the outboard motor according to the first preferred embodiment shown in FIG. 1.

The dog clutch 358 is attached to an outer surface of the rear propeller drive shaft 354 preferably by spline-fitting, so that the dog clutch 368 can slide with respect to the rear propeller drive shaft 354 as described above, and can also rotate together with the rear propeller drive shaft 354. That is, the dog clutch 358 is constructed to rotate with the rear propeller drive shaft 354 at all times. A front dog 358*a* is disposed in the dog clutch 358 on the arrow FWD side. Also, a rear dog 358*b* is disposed in the dog clutch 358 on the arrow BWD side. As shown in FIG. 6, when the dog clutch 358 is slid in the arrow FWD direction, the front dog 358*a* is engaged with a dog 369*a* of the output shaft 369 described below. Meanwhile, as shown in FIG. 7, when the dog clutch 358 is slid in the arrow BWD direction, the rear dog 358*b* is engaged with the dog 351*b* of the front bevel gear 351. That is, as shown in FIG. 6, when the dog clutch 358 is engaged with the output shaft 369 of the reverse drive 364 described below, the rotation of the output shaft 369 of the reverse drive 364 is transmitted to the rear propeller drive shaft 354. On the other hand, as shown in FIG. 7, when the dog clutch 358 is engaged with the front bevel gear 351, the rotation of the front bevel gear 351 is directly transmitted to the rear propeller drive shaft 354. As shown in FIG. 5, when the dog clutch 358 is in a neutral position where the dog clutch 358 is not engaged with the front bevel gear 351 and the output shaft 369, the driving force of the bevel gear 350 is not transmitted to the front propeller drive shaft 353 and the rear propeller drive shaft 354.

In the first preferred embodiment, the dog clutch 359 is arranged to cover an outer surface of the dog clutch 358 and constructed to be slid in the fore-and-aft direction together with the dog clutch 358. As described above, the dog clutch 359 is attached to an outer surface of the front bevel gear 351 preferably by spline-fitting, so that the dog clutch 369 can slide with respect to the front bevel gear 351 and can rotate with the front bevel gear 351. That is, the dog clutch 359 is constructed to rotate together with the front bevel gear 351 at all times. A dog 359*a* is disposed in the dog clutch 359 on the arrow FWD side. As shown in FIG. 6, when the dog clutch 359 is slid in the arrow FWD direction, the dog 359*a* is engaged with a dog 368*a* of the input shaft 368 described below. On the other hand, as shown in FIG. 7, when the dog clutch 359 is slid in the arrow BWD direction, the dog 359*a* is disengaged from a dog 368*a* of the input shaft 368. That is, as shown in FIG. 6, when the dog clutch 358 is engaged with the input shaft 368 of the reverse drive 364 described below, rotation of the front bevel gear 351 is transmitted to the input shaft 368 of the reverse drive 364.

Figure 8:
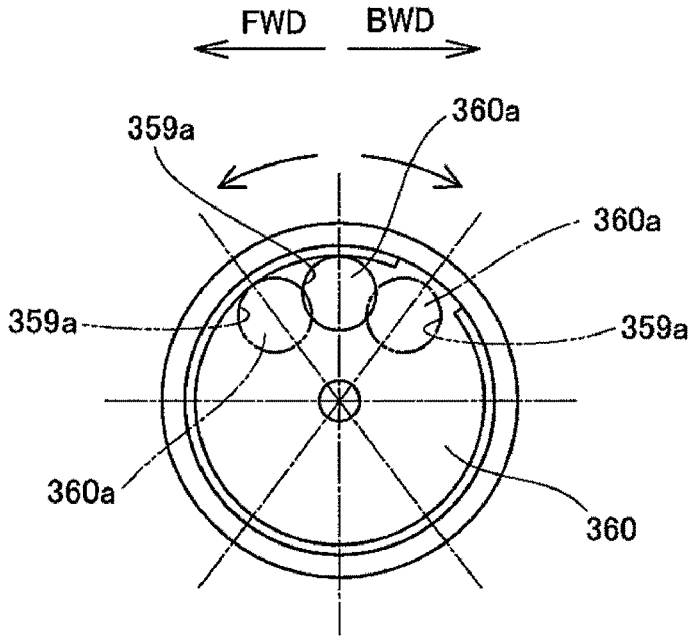
FIG. 8 is a cross-sectional view taken along the line of FIG. 5.

As shown in FIG. 5, a groove 359*b* is formed in the entire outer surface of the dog clutch 359. As shown in FIG. 5 and FIG. 8, a convex portion 360*a* of a forward-reverse switching lever 360 is engaged with the groove 359*b*, and the dog clutch 359 can be shifted in the fore-and-aft direction when the convex portion 360*a* is shifted in the fore-and-aft direction in accordance with the rotation of the forward-reverse switching lever 360. In the first preferred embodiment, as shown in FIG. 2, the forward-reverse switching lever 360 is connected to an actuator (not shown) arranged in the case 300 via a linkage 361. The forward-reverse switching lever 360 is rotated when the actuator (not shown) is driven.

In the first preferred embodiment, a dog clutch 362 is fixed to the connecting member 357. The clutch 362 is an example of the "first clutch" in a preferred embodiment of the present invention. The dog clutch 362 is attached to an outer surface of the front propeller drive shaft 353 preferably by spline-fitting, so that the dog clutch 362 can slide with respect to the front propeller drive shaft 353 as described above and can rotate together with the front propeller drive shaft 353. That is, the dog clutch 362 is constructed to rotate together with the front propeller drive shaft 353 at all times. A front dog 362*a* is disposed in the dog clutch 362 on the arrow FWD side. Also, a rear dog 362*b* is disposed in the dog clutch 362 on the arrow BWD side. As shown in FIG. 6, when the dog clutch 362 is slid in the arrow FWD direction, the front dog 362*a* is engaged with the dog 351*c* of the front bevel gear 351. On the other hand, as shown in FIG. 7, when the dog clutch 362 is slid in the arrow BWD direction, the rear dog 362*b* is engaged with the dog 352*b* of the rear bevel gear 352. That is, as shown in FIG. 6, when the dog clutch 362 is engaged with the front bevel gear 351, rotation of the front bevel gear 351 is directly transmitted to the front propeller drive shaft 353. On the other hand, as shown in FIG. 7, when the dog clutch 362 is engaged with the rear bevel gear 352, rotation of the rear bevel gear 352 is directly transmitted to the front propeller drive shaft 353. As shown in FIG. 5, when the dog clutch 362 is in a neutral position where the dog clutch 362 is not engaged either with the front bevel gear 351 or with the rear bevel gear 352, driving force of the bevel gear 350 is not transmitted to the front propeller drive shaft 353 and the rear propeller drive shaft 354.

The dog clutch 362 is slid in the fore-and-aft direction together with the dog clutches 358 and 359 via the connecting members 355, 356, and 357. That is, the dog clutch 362 can move in the fore-and-aft direction in accordance with the rotation of the forward-reverse switching lever 360 in the same way as the dog clutches 358 and 359. In the first preferred embodiment, the forward-reverse drive 363 is constituted by the connecting members 355, 356, and 357, and the dog clutches 358, 359, and 362. The forward-reverse drive 363 is arranged on the axis L2 and driven during the forward travel and reverse travel of the boat 1.

In the first preferred embodiment, the reverse drive 364, which is driven during the reverse travel of the boat 1, is disposed in the forward-reverse drive 363 on the axis L2 in the arrow FWD side. That is, the reverse drive 364 is disposed in the rear propeller drive shaft 354 on an arrow FWD side that is the opposite of an arrow BWD side in which the rear propeller 34*b* of the rear propeller drive shaft 354 is disposed. The forward-reverse drive 363 and the reverse drive 364 are examples of the "forward-reverse switching mechanism" in a preferred embodiment of the present invention. The reverse drive 364 preferably includes: a bevel gear 365 and a bevel gear 366 that can be rotated about the axis L2; three bevel gears 367 arranged between the bevel gear 365 and the bevel gear 366; the input shaft 368 that is attached to the bevel gear 365 and that can be connected with the dog clutch 359; the output shaft 369 that is attached to the bevel gear 366 and that can be connected with the dog clutch 358. The bevel gear 365 is an example of the "third bevel gear" in a preferred embodiment of the present invention, and the rear bevel gear 366 is an example of the "fifth bevel gear" in a preferred embodiment of the present invention. The bevel gear 367 is an example of the "fourth bevel gear" in a preferred embodiment of the present invention. The input shaft 368 is an example of the "input portion" in a preferred embodiment of the present invention, and the output shaft 369 is an example of the "output portion" in a preferred embodiment of the present invention.

In the first preferred embodiment, the bevel gear 365 is preferably spline-fitted to an outer surface of the input shaft 368 on the arrow FWD side and constructed to be rotatable together with the input shaft 368. The input shaft 368 is formed in the hollow shape along the axis L2. The arrow FWD side of the input shaft 368 is in the cylindrical shape. The arrow BWD side of the input shaft 368 is larger in diameter than the arrow FWD side thereof. The dog 368*a* is disposed in the end portion of the input shaft 368 on the arrow BWD side. The dog 368*a* can be engaged with or disengaged from the dog 359*a* of the dog clutch 359. In other words, as shown in FIG. 6, the bevel gear 365 is rotated in the same direction (R1 direction) as the front bevel gear 351, when the input shaft 368 is engaged with the dog clutch 359.

Figure 9:
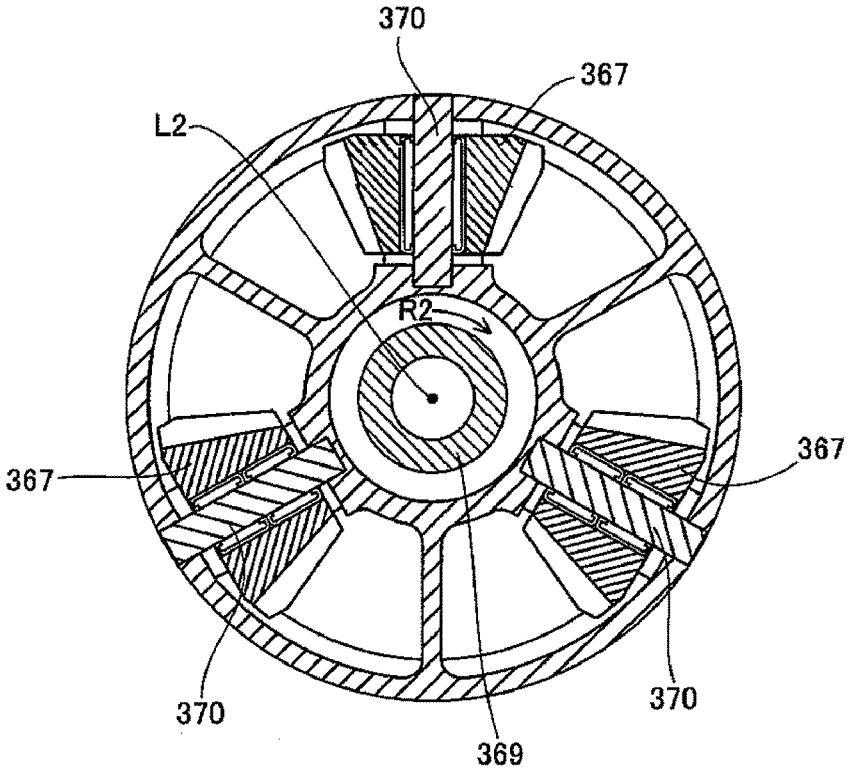
FIG. 9 is a cross-sectional view taken along the line of FIG. 5.

In the first preferred embodiment, as shown in FIG. 5 and FIG. 9, the three bevel gears 365 preferably are meshed with the bevel gear 367. As shown in FIG. 9, the three bevel gears 367 preferably are rotatably supported by the rotational shaft 370, which extends in a direction that is perpendicular or substantially perpendicular to the bevel gear 365. As shown in FIG. 5, the three bevel gears 367 are meshed with the bevel gear 366. According to this arrangement of the bevel gears 365, 366, and 367, it is possible to reverse the rotational direction of the bevel gear 365 (R2 direction) with respect to the rotational direction of the bevel gear 366 (R1 direction). The bevel gear 366 is spline-fitted to an outer surface of the output shaft 369 in the arrow FWD side and is constructed to be rotatable with the output shaft 369. The output shaft 369 preferably has a cylindrical shape, and a portion thereof in the BWD side is inserted in an opening of the input shaft 368 via a bearing 371 so as to be rotatable with respect to the input shaft 368. A dog 369*a* is disposed in the end portion of the output shaft 369 on the arrow BWD side. The dog 369*a* is arranged on the outside of an outer surface of the rear propeller drive shaft 354 and constructed to be engaged with or disengaged from the front dog 358*a* of the dog clutch 358, which is positioned on the outside of the outer surface of the rear propeller drive shaft 354.

Now, a driving force transmission path in the lower mechanism 35 is described in detail. First, description is provided of the driving force transmission path upon the reverse travel when the forward-reverse drive 363 (dog clutches 358, 359, 362) is shifted in the arrow FWD direction.

As shown in FIG. 2, when the crankshaft 30*a* is rotated in the A direction by the drive of the engine 30, the upper drive shaft 31 is rotated in the A direction. As shown in FIG. 3, the rotation of the upper drive shaft 31 in the A direction is input to the transmission mechanism 32. In the case that the clutch 322 is engaged in the transmission mechanism 32, the rotation of the upper drive shaft 31 in the A direction is transmitted to the intermediate shaft 324 without substantial speed reduction. Accordingly, the intermediate shaft 324 is rotated in the A direction substantially at the same speed as the upper drive shaft 31. On the other hand, in the case that the clutch 322 is disengaged in the transmission mechanism 32, the rotation of the upper drive shaft 31 in the A direction is transmitted to the intermediate shaft 324 at a reduced speed. In this case, the intermediate shaft 324 is rotated in the A direction at a slower rotational speed than the upper drive shaft 31. That is, the rotational direction of the upper drive shaft 31 in the A direction is not changed in the transmission mechanism 32, and the rotation of the upper drive shaft 31 is output from the intermediate shaft 324 with rotation in the A direction.

After that, the lower drive shaft 33 is rotated in the A direction in accordance with the rotation of the intermediate shaft 324 in the A direction. As shown in FIG. 5, the rotation of the lower drive shaft 33 in the A direction is input to the lower mechanism 35.

In accordance with the rotation of the lower drive shaft 33 in the A direction, the bevel gear 350 attached to the vicinity of a lower end portion of the lower drive shaft 33 is rotated in the A direction. In accordance with the rotation of the bevel gear 350 in the A direction, the front bevel gear 351 is rotated in the R1 direction, and the rear bevel gear 352 is rotated in the R2 direction. The R1 direction is an example of the "second direction" in a preferred embodiment of the present invention, and the R2 direction is an example of the "first direction" in a preferred embodiment of the present invention.

Now, while referring to FIG. 2 and FIG. 6, description is provided of a driving force transmission path that transmits the driving force of the lower drive shaft 33 (engine 30) to the front propeller drive shaft 353 in the case that the forward-reverse drive 363 (dog clutches 358, 359, 362) is shifted in the arrow FWD direction. As shown in FIG. 6, since the forward-reverse drive 363 (dog clutches 358, 359, 362) is shifted in the arrow FWD direction, the front dog 362*a* of the dog clutch 362 is engaged with the dog 351*c* of the front bevel gear 351. Accordingly, the rotation of the front bevel gear 351 in the R1 direction is transmitted to the dog clutch 362, and the dog clutch 362 is rotated in the R1 direction. Because the dog clutch 362 is attached to the front propeller drive shaft 353, the front propeller shaft 353 is rotated in the R1 direction. As a result, the front propeller 34*a* is rotated in the R1 direction as shown in FIG. 4. At this time, as shown in FIG. 6, the rear dog 362*b* of the dog clutch 362 is not engaged with the dog 352*b* of the rear bevel gear 352. Thus, the rear bevel gear 352 idles with respect to the front propeller drive shaft 353. That is, the rotation of the rear bevel gear 352 in the R2 direction is not transmitted to either the front propeller drive shaft 353 or the rear propeller drive shaft 354.

Now, while referring to FIG. 2 and FIG. 6, description is provided of a driving force transmission path, which transmits the driving force of the lower drive shaft 33 (engine 30) to the rear propeller drive shaft 354 in the case that the forward-reverse drive 363 (dog clutches 358, 359, 362) is shifted in the arrow FWD direction. As shown in FIG. 6, since the forward-reverse drive 363 (dog clutches 358, 359, 362) is shifted in the arrow FWD direction, the front dog 358*a* of the dog clutch 358 is engaged with the dog 369*a* of the output shaft 369, and the dog 359*a* of the dog clutch 359 is engaged with the dog 368*a* of the input shaft 368.

As described above, because the front bevel gear 351 is rotated in the R1 direction, the dog clutch 359 is rotated in the R1 direction in the same way as the front bevel gear 351. Accordingly, the input shaft 368 is rotated in the R1 direction via the dog clutch 359. Because the bevel gear 368 is attached to the input shaft 365, the bevel gear 365 is rotated about the axis L2 in the R1 direction.

In the first preferred embodiment, the rotation of the bevel gear 365 in the R1 direction is transmitted to the three bevel gears 367 that are meshed with the bevel gear 365. The three bevel gears 367 are rotated about the rotational shaft 370 in the B direction in accordance with the rotation of the bevel gear 365 in the R1 direction. The rotation of the three bevel gears 367 in the B direction is transmitted to the bevel gear 366. The bevel gear 366 is rotated about the axis L2 in the R2 direction in accordance with the rotation of the three bevel gears 367 in the B direction. That is, by the bevel gears 365, 366, and 367, the rotation of the bevel gear 365 in the R1 direction is changed to the rotation in the R2 direction in the bevel gear 366. The rotation of the bevel gear 366 in the R2 direction is transmitted to the output shaft 369, and the output shaft 369 is rotated about the axis L2 in the R2 direction.

Since the dog 369*a* of the output shaft 369 and the front dog 358*a* of the dog clutch 358 are engaged, the rotation of the output shaft 369 in the R2 direction is transmitted to the dog clutch 358. The dog clutch 358 is rotated in the R2 direction. The rear propeller drive shaft 354, to which the dog clutch 358 is attached, is rotated in the R2 direction. As a result, the rear propeller 34*b* is rotated in the R2 direction as shown in FIG. 4.

As described above, when the forward-reverse drive 363 (dog clutches 358, 359, 362) is shifted in the arrow FWD direction, the front propeller 34*a* is rotated in the R1 direction, and the rear propeller 34*b* is rotated in the R2 direction. As a result, the boat 1 is propelled (reversed) in the arrow BWD direction.

Now, while referring to FIG. 2 and FIG. 7, description is provided of a driving force transmission path, which transmits the driving force of the lower drive shaft 33 (engine 30) to the front propeller drive shaft 353 in the case that the forward-reverse drive 363 (dog clutches 358, 359, 362) is shifted in the arrow BWD direction when the boat 1 is propelled forward. As shown in FIG. 7, since the forward-reverse drive 363 (dog clutches 358, 359, 362) is shifted in the arrow BWD direction, the rear dog 362*b* of the dog clutch 362 is engaged with the dog 352*b* of the rear bevel gear 352. As described above, because the rear bevel gear 352 is rotated in the R2 direction, the dog clutch 362 is rotated in the R2 direction in the same way as the rear bevel gear 352. Accordingly, the front propeller drive shaft 353 is rotated in the R2 direction via the dog clutch 362. As a result, the front propeller 34*a* is rotated in the R2 direction as shown in FIG. 4.

Now, while referring to FIG. 2 and FIG. 7, description is provided of a driving force transmission path, which transmits the driving force of the lower drive shaft 33 (engine 30) to the rear propeller drive shaft 354 in the case that the forward-reverse drive 363 (dog clutches 358, 359, 362) is shifted in the arrow BWD direction. As shown in FIG. 7, since the forward-reverse drive 363 (dog clutches 358, 359, 362) is shifted in the arrow BWD direction, the rear dog 358*b* of the dog clutch 358 is engaged with the dog 351*b* of the front bevel gear 351. In this case, the dog 359*a* of the dog clutch 359 is not engaged with the dog 368*a* of the input shaft 368. As described above, because the front bevel gear 351 is rotated in the R1 direction, the dog clutch 358 is rotated in the R1 direction in the same way as the front bevel gear 351. Accordingly, the rear propeller drive shaft 354, to which the dog clutch 358 is attached, is rotated in the R1 direction. As a result, the rear propeller 34*b* is rotated in the R1 direction, as shown in FIG. 4. As shown in FIG. 7, the dog clutch 359 is not engaged with the input shaft 368 of the reverse drive 364. Thus, when the forward-reverse drive 363 is shifted in the arrow BWD direction (when the boat 1 is propelled forward), the driving force of the lower drive shaft 33 (engine 30) is not transmitted. Therefore, the driving force of the lower drive shaft 33 (engine 30) is not transmitted to the reverse drive 364.

As described above, when the forward-reverse drive 363 (dog clutches 358, 359, 362) is shifted in the arrow BWD direction, the front propeller 34*a* is rotated in the R2 direction, and the rear propeller 34*b* is rotated in the R1 direction. As a result, the boat 1 is propelled (advanced) in the arrow FWD direction.

As described above, the boat propulsion unit according to the first preferably embodiment preferably includes: the front propeller 34*a* that is rotated together with the front propeller drive shaft 353 during both of the forward travel and reverse travel of the boat 1; the rear propeller 34*b* that is rotated together with the rear propeller drive shaft 354 in the opposite direction of the front propeller 34*a* during both of the forward travel and reverse travel of the boat 1; and the forward-reverse drive 363 and the reverse drive 364, which can be switched between the direction in which the front propeller drive shaft 353 and the rear propeller drive shaft 354 are rotated during the forward travel of the boat and the direction in which the front propeller drive shaft 353 and the rear propeller drive shaft 354 are rotated during the reverse travel of the boat 1, on the axis L2 of the front propeller drive shaft 353 and the rear propeller drive shaft 354. Accordingly, when the boat 1 is propelled either forward or in reverse, the front propeller 34*a* can be rotated via the front propeller drive shaft 353, and the rear propeller 34*b* can be rotated via the rear propeller drive shaft 354 at the same time, by the forward-reverse drive 363 and the reverse drive 364. That is, since the front propeller 34*a* and the rear propeller 34*b* can also be rotated during the reverse travel of the boat 1, sufficient propulsive force for the reverse travel can be obtained.

In the first preferred embodiment, as described above, since the forward-reverse drive 363 is provided with the dog clutch 362 that is engaged during the forward travel and reverse travel of the boat 1 and that transmits the driving force of the engine 30 to the front propeller drive shaft 353, the driving force of the engine 30 can easily be engaged with or disengaged from the front propeller drive shaft 353. Also, since the forward-reverse drive 363 is provided with the dog clutch 358 that is engaged during the forward travel and reverse travel of the boat 1 and that transmits the driving force of the engine 30 to the rear propeller drive shaft 354, and the dog clutch 359 that is engaged during the reverse travel of the boat 1 and that transmits the driving force of the engine 30 to the reverse drive 364, the driving force of the engine 30 can easily be engaged with or disengaged from the reverse drive 364 and the rear propeller drive shaft 354.

In the first preferred embodiment, as described above, when the boat 1 is propelled forward, the rear bevel gear 352 and the front propeller drive shaft 353 are engaged by the dog clutch 362 to rotated the front propeller drive shaft 353 in the R2 direction, and the front bevel gear 351 and the rear propeller drive shaft 354 are engaged by the dog clutch 358 to rotate the rear propeller drive shaft 354 in the R1 direction. Accordingly, the front propeller drive shaft 353 can easily be rotated in the R2 direction by the dog clutch 362, and the rear propeller drive shaft 354 can easily be rotated in the R1 direction by the dog clutch 358.

In the first preferred embodiment, as described above, when the boat 1 is propelled in reverse, the front bevel gear 351 and the front propeller drive shaft 353 are engaged by the dog clutch 362 to rotate the front propeller drive shaft 353 in the R1 direction, and the front bevel gear 351 and the reverse drive 364 are engaged by the dog clutch 359, and the reverse drive 364 and the rear propeller drive shaft 354 are engaged by the dog clutch 358 to rotate the rear propeller drive shaft 354 in the R2 direction. Accordingly, when the boat 1 is propelled in reverse, the front propeller drive shaft 353 can easily be rotated in the R1 direction, and the rear propeller drive shaft 354 can easily be rotated in the R2 direction by the dog clutch 358 and the dog clutch 359.

In the first preferred embodiment, as described above, by disposing the forward-reverse switching lever 360 that is shifted to be engaged with or disengaged from the dog clutch 362, the dog clutch 358, and the dog clutch 359, switching between the advance travel and the reverse travel of the boat 1 can easily be performed by the forward-reverse switching lever 360.

In the first preferred embodiment, as described above, the reverse drive 364 preferably includes: the input shaft 368 that is engaged with the front bevel gear 351 via the dog clutch 359 and that is rotated in the R1 direction which is the same rotational direction as the front bevel gear 351 during the reverse travel of the boat 1; and the output shaft 369 that is engaged with the rear propeller drive shaft 354 via the dog clutch 358 and that is rotated in the opposite direction of the rotation of the front bevel gear 351. Rotational input of the front bevel gear 351 in the R1 direction, which is input from the input shaft 368, can be converted to the rotational input in the R2 direction that is opposite of the rotational direction of the front bevel gear 351 and can be output from the output shaft 369.

In the first preferred embodiment, as described above, the reverse drive 364 is constructed such that the output shaft 369 is rotated in the R2 direction which is the opposite of the rotational direction (R1 direction) of the front bevel gear 351 input to the input shaft 368 by combination of the plurality of bevel gears. Accordingly, the rotation of the front bevel gear 351 can easily be transmitted to the rear propeller drive shaft 354 in the reversed rotational direction.

In the first preferred embodiment, as described above, the reverse drive 364 preferably includes: the bevel gear 365 that constitutes the input shaft 368 with which the dog clutch 359 is engaged, and that is rotated in the R1 direction which is the same rotational direction (R1 direction) as the front bevel gear 351; the bevel gear 367 that is meshed with the bevel gear 365 and that is rotated in the opposite direction (B direction) of the direction (A direction) in which the lower drive shaft 33 is rotated; the bevel gear 366 that is meshed with the bevel gear 367 and that is rotated in the opposite rotational direction (R2) of the bevel gear 365; and the output shaft 369 that is provided with the bevel gear 366, that constitutes the output shaft 369 with which the dog clutch 358 is engaged, that is rotated with the bevel gear 366 in the R2 direction, and that rotates the rear propeller drive shaft 354 in the R2 direction. Thus, the rotational direction R1 of the front bevel gear 351 can easily be converted to the opposite direction. Accordingly, the rear propeller drive shaft 354 can easily be rotated in the R2 direction.

In the first preferred embodiment, as described above, since the reverse drive 364 is arranged on the other side (arrow FWD side) of the rear propeller drive shaft 354, the space in the arrow FWD side end of the lower mechanism 35 of the outboard motor 3 can be used effectively.

In the first preferred embodiment, as described above, when the boat 1 is propelled forward, the driving force of the engine 30 is not transmitted to the reverse drive 364. Accordingly, since the reverse drive 364 is not driven during the forward travel of the boat 1, power loss that is generated by drive of the reverse drive 364 during the forward travel of the boat 1 can be prevented.

Second Preferred Embodiment

Figure 10:
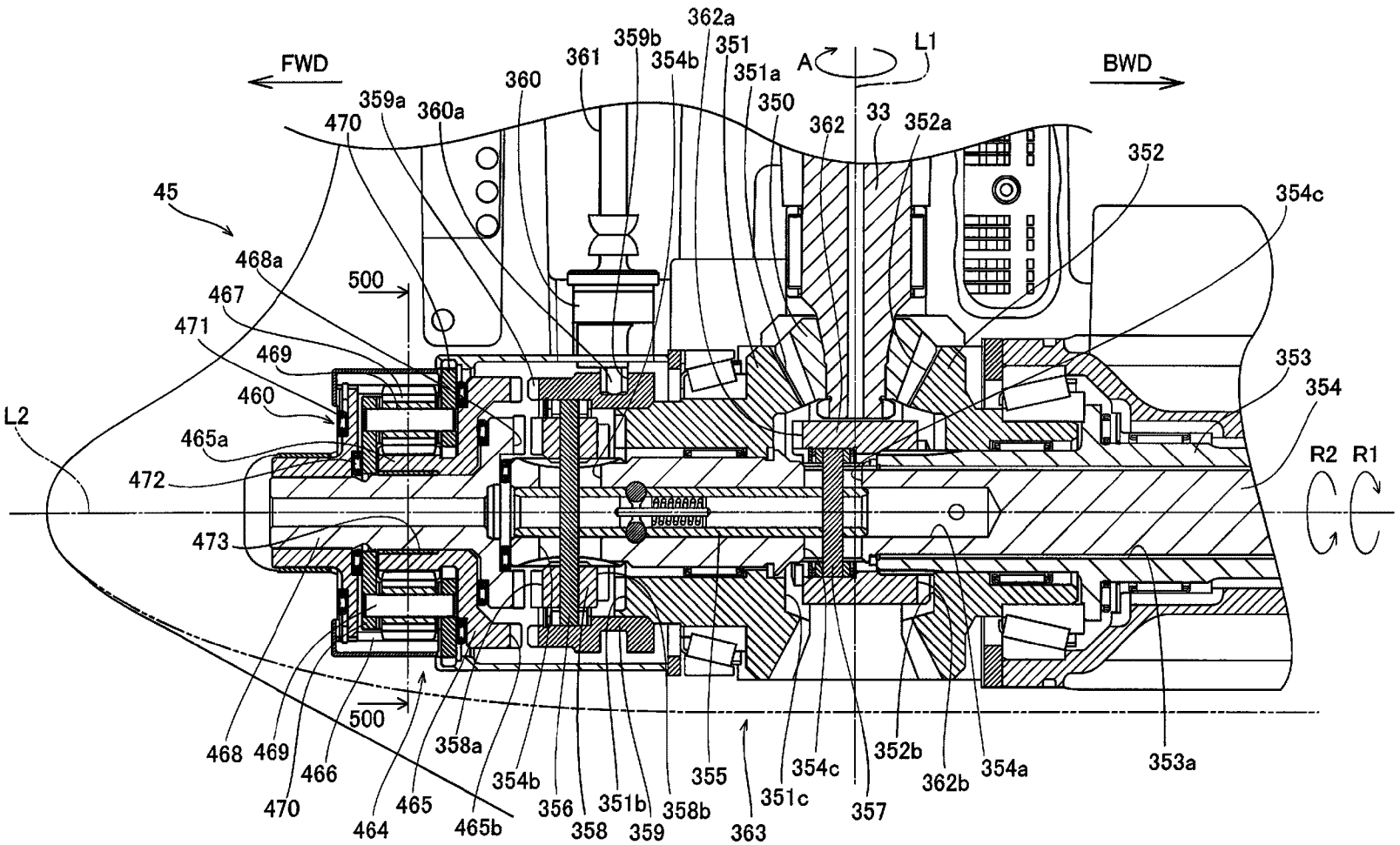
FIG. 10 is a cross-sectional view for explaining the construction of the lower mechanism of an outboard motor according to a second preferred embodiment of the present invention.
Figure 11:
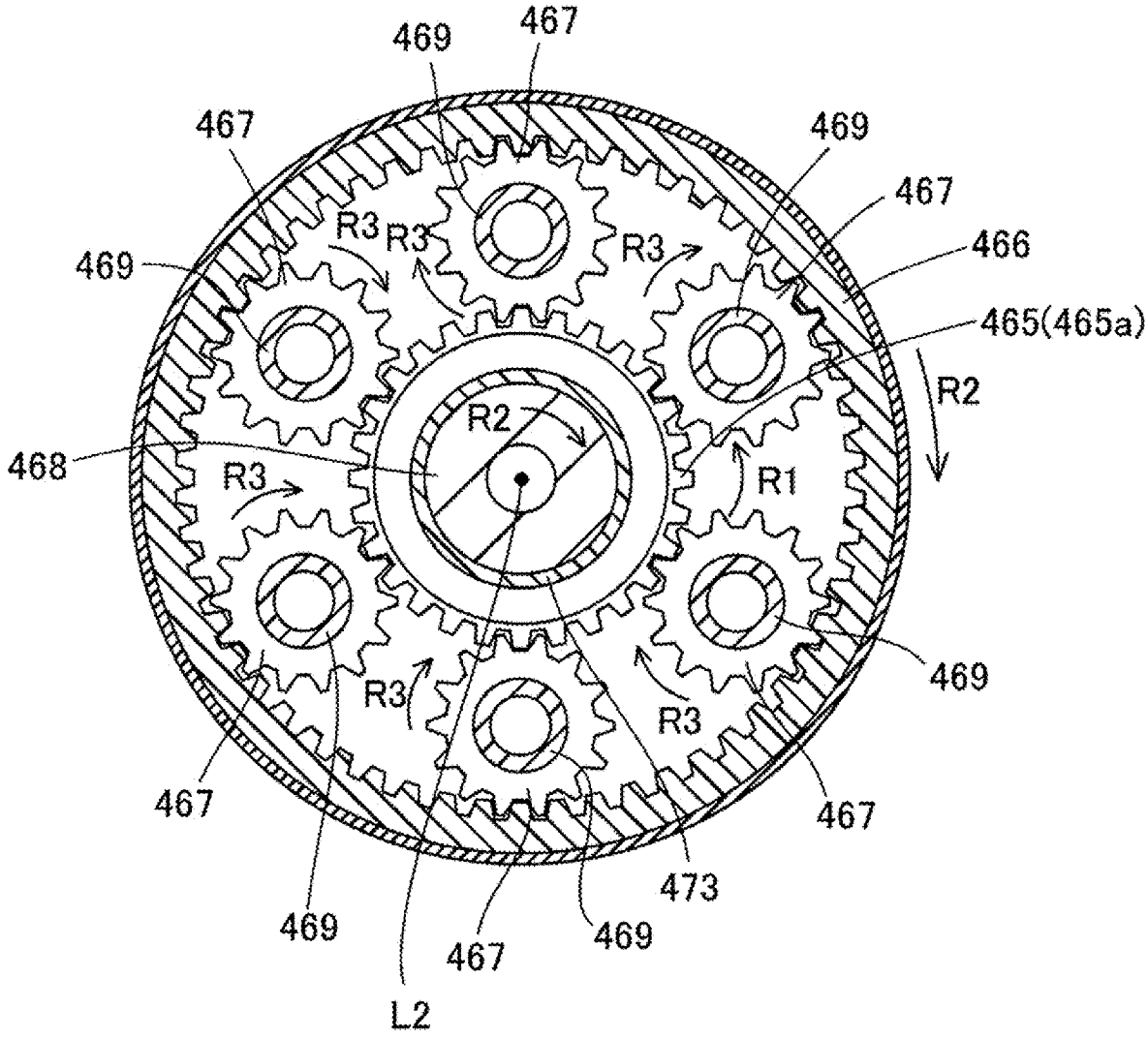
FIG. 11 is a cross-sectional view taken along the line of FIG. 10.

FIGS. 10 and 11 illustrate construction of a lower mechanism of an outboard motor according to a second preferred embodiment of the present invention. Hereinafter, construction of the outboard motor according to the second preferred embodiment of the present invention will be described in detail with reference to FIG. 10 and FIG. 11. In the second preferred embodiment, unlike the first preferred embodiment described above, description is provided of an example in which the reverse drive is not provided with a plurality of bevel gears but provided with a single pinion planetary gear mechanism.

In the second preferred embodiment, as shown in FIG. 10, the reverse drive 464, which is driven during the reverse travel of the boat 1, is disposed in the forward-reverse drive 363 on the axis L2 on the arrow FWD side. That is, the reverse drive 464 is arranged on a side (arrow FWD side) that is opposite of an arrow BWD side in which the rear propeller 34*b* of the rear propeller drive shaft 354 is disposed. The reverse drive 464 is an example of the "forward-reverse switching mechanism" in a preferred embodiment of the present invention. The reverse drive 464 preferably includes: a sun gear 465 and a ring gear 466 that can be rotated about the axis L2; six pinion gears 467 that are arranged between the sun gear 465 and the ring gear 466; an output shaft 468 that can be connected between the ring gear 466 and the dog clutch 358. A planetary gear mechanism 460 is constructed with the sun gear 465, the ring gear 466, and the six pinion gears 467.

In the second preferred embodiment, the sun gear 465 preferably includes: a gear 465*a* that is disposed on the arrow FWD side; and a dog 465*b* that is disposed on the arrow BWD side. The dog 465*b* is an example of the "input portion" in a preferred embodiment of the present invention. An arrow FWD side portion of the sun gear 465 preferably has the shape of a cylinder that extends along the axis L2. The gear 465*a* is formed on the outer edge of the cylindrical portion. An arrow BWD side portion of the sun gear 465 preferably has the shape of a flange that expands in a direction perpendicular or substantially perpendicular to the axis L2, and is formed with the dog 465*b* that protrudes in the arrow BWD direction from a portion near an outer edge of the flange.

The dog 465*b* can be engaged with or disengaged from the dog 359*a* of the dog clutch 359. That is, when the sun gear 465 is engaged with the dog clutch 359, the sun gear 465 is rotated in the same direction (R1 direction) as the front bevel gear 351.

In the second preferred embodiment, the sun gear 465 is meshed with the six pinion gears 467. As shown in FIG. 11, each of the six pinion gears 467 can be rotated about a rotational shaft 469 that extends in parallel with the axis L2. As shown in FIG. 10, the rotational shafts 469 are supported by a carrier 470. The carrier 470 is fixed to the lower mechanism 45. The carrier 470 can be rotated with respect to the sun gear 465. The six pinion gears 467 are each meshed with the ring gear 466. According to this arrangement of the sun gear 465, the ring gear 466, and the six pinion gears 467, it is possible to reverse the rotational direction of the ring gear 466 (to the R2 direction) with respect to the rotational direction (R1 direction) of the sun gear 465. A thrust bearing 471 is arranged between the ring gear 466 and the lower mechanism 45, and a thrust bearing 472 is arranged between the ring gear 466 and the carrier 470. Accordingly, the ring gear 466 can be rotated with respect to the lower mechanism 45 and the carrier 470. The ring gear 466 is attached to an outer surface of the output shaft 468 on the arrow FWD side and is constructed to be rotatable together with the output shaft 468. The output shaft 468 is formed in the shape of a cylinder. A portion of an arrow BWD side of the output shaft 468 is inserted in an opening of the sun gear 465. A bush 473, which supports the sun gear 465 and the output shaft 468 to be rotatable in opposite directions, is arranged between an inner surface of the opening of the sun gear 465 and the outer surface of the output shaft 468. A dog 468*a* is disposed in the output shaft 468 on the arrow BWD side. The output shaft 468 is an example of the "output portion" in a preferred embodiment of the present invention. The dog 468*a* is arranged on the outside of an outer surface of the rear propeller drive shaft 354 and is constructed to be engaged with or disengaged from the front dog 358*a* of the dog clutch 358, which is positioned on the outside of an outside surface of the rear propeller drive shaft 354.

Other constructions of the second preferred embodiment are preferably the same as those of the first preferred embodiment.

Now, with reference to FIG. 10 and FIG. 11, description is provided of a driving force transmission path in the lower mechanism during the reverse travel of the boat according to the second preferred embodiment. In the second preferred embodiment, description is provided about a driving force transmission path that transmits the driving force of the lower drive shaft 33 (engine 30) to the rear propeller drive shaft 354 in the case that the forward-reverse drive 363 (dog clutches 358, 359, 362) is shifted in the arrow FWD direction during the reverse travel of the boat 1.

As shown in FIG. 10, since the forward-reverse drive 363 (dog clutches 358, 359, 362) is shifted in the arrow FWD direction, the front dog 358*a* of the dog clutch 358 is engaged with the dog 468*a* of the output shaft 468, and the dog 359*a* of the dog clutch 359 is engaged with the dog 465*b* of the sun gear 465.

As described above, because the front bevel gear 351 is rotated in the R1 direction, the dog clutch 359 is rotated in the R1 direction in the same way as the front bevel gear 351. Accordingly, as shown in FIG. 10, the sun gear 465 is rotated about the axis L2 in the R1 direction via the dog clutch 359. In the second preferred embodiment, the rotation of the sun gear 465 in the R1 direction is transmitted to the six pinion gears 467 that are meshed with the sun gear 465. As shown in FIG. 11, the six pinion gears 467 are rotated about the rotational shaft 469 in an R3 direction in accordance with the rotation of the sun gear 465 in the R1 direction. The rotation of the six pinion gears 467 in the R3 direction is transmitted to the ring gear 466. The ring gear 466 is rotated about the axis L2 in the R2 direction in accordance with the rotation of the six pinion gears 467 in the R3 direction. That is, rotation of the sun gear 465 in the R1 direction is changed its direction to the R2 direction in the ring gear 466 by the sun gear 465, the ring gear 466, and the six pinion gears 467. The rotation of the ring gear 466 in the R2 direction is transmitted to the output shaft 468, and the output shaft 468 is rotated about the axis L2 in the R2 direction.

Since the dog 468*a* of the output shaft 468 and the front dog 358*a* of the dog clutch 358 are engaged, the rotation of the output shaft 468 in the R2 direction is transmitted to the dog clutch 358. The dog clutch 358 is rotated in the R2 direction. The rear propeller drive shaft 354, to which the dog clutch 358 is attached, is rotated in the R2 direction.

In the case that the forward-reverse drive 363 (dog clutches 358, 359, 362) is shifted in the arrow FWD direction, the driving force transmission path, through which the driving force of the lower drive shaft 33 (engine 30) is transmitted to the front propeller drive shaft 353, is the same as that of the first preferred embodiment described above. The driving force transmission path, in which the forward-reverse drive 363 (dog clutches 358, 359, 362) is shifted in the arrow BWD direction, is the same as that of the first preferred embodiment described above.

In the second preferred embodiment, as described above, the rear propeller drive shaft 354 is rotated in the R2 direction, which is the opposite of the rotational direction (R1 direction) of the front bevel gear 351, by using the planetary gear mechanism 460 of the reverse drive 464. Thus, the rotational direction of the front bevel gear 351 can easily be transmitted to the rear propeller drive shaft 354 in reversed rotation.

Third Preferred Embodiment

Figure 12:
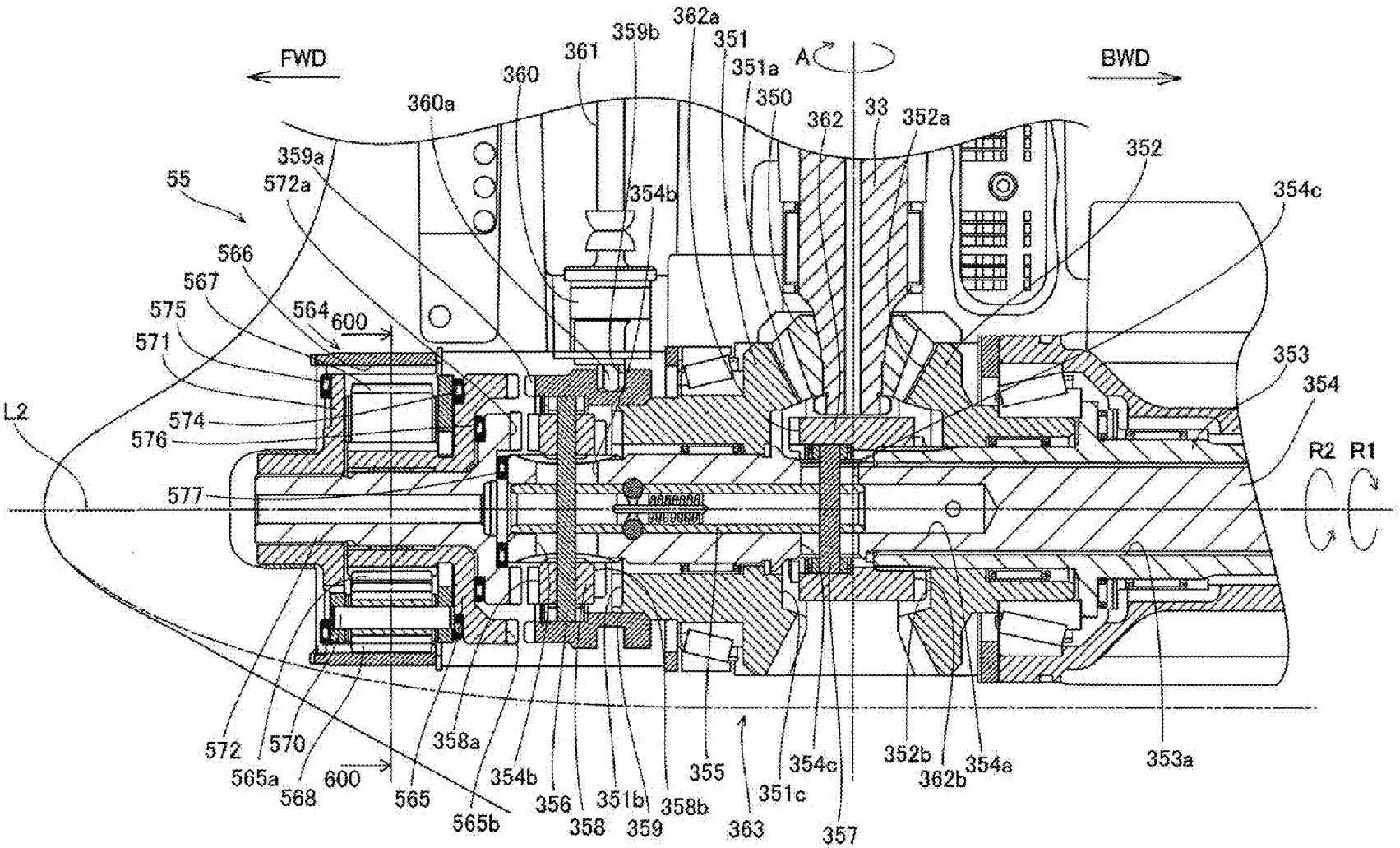
FIG. 12 is a cross-sectional view for explaining the construction of a lower mechanism of an outboard motor according to a third preferred embodiment of the present invention.
Figure 13:
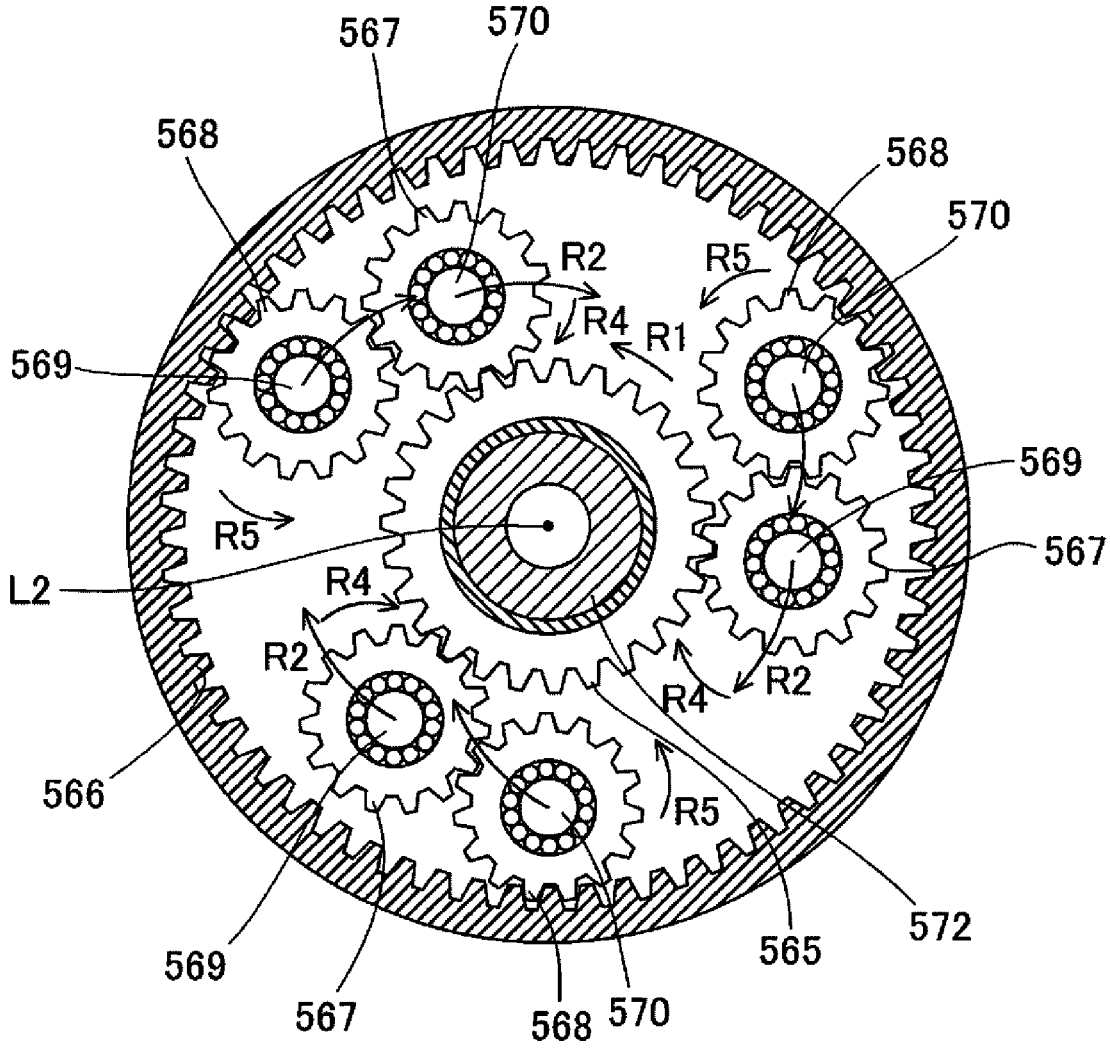
FIG. 13 is a cross-sectional view taken along the line of FIG. 12.

FIG. 12 and FIG. 13 illustrate construction of a lower mechanism 55 of an outboard motor according to a third preferred embodiment of the present invention. Hereinafter, construction of the outboard motor according to the third preferred embodiment of the present invention will be described in detail with reference to FIG. 12 and FIG. 13. In the third preferred embodiment, description is provided of an example in which a double pinion planetary gear mechanism is provided in place of the single pinion planetary gear mechanism.

In the third preferred embodiment, as shown in FIG. 12, a reverse drive 564, which is driven during the reverse travel of the boat 1, is disposed in the forward-reverse drive 363 on the axis L2 on the arrow FWD side. That is, the reverse drive 564 is arranged on a side (arrow FWD side) that is opposite of an arrow BWD side in which the rear propeller 34*b* of the rear propeller drive shaft 354 is disposed. The reverse drive 564 is an example of the "forward-reverse switching mechanism" in a preferred embodiment of the present invention. The reverse drive 564 preferably includes: a sun gear 565 and the ring gear 566 that can be rotated about the axis L2; and three first pinion gears 567 and three second pinion gears 568 that are arranged between the sun gear 565 and the ring gear 566. The reverse drive 564 further includes: a rotational shaft 569 (refer to FIG. 13) that rotatably holds the first pinion gear 567; a rotational shaft 570 that rotatably holds the second pinion gear 568; a carrier 571 that supports the rotational shaft 569 (refer to FIG. 13) and the rotational shaft 570 and that can be rotated about the axis L2; and an output shaft 572 that can connect the carrier 571 with the dog clutch 358. A planetary gear mechanism 573 is constructed with the sun gear 565, the ring gear 566, the three first pinion gears 567, and the three second pinion gears 568.

In the third preferred embodiment, the sun gear 565 preferably includes: a gear 565*a* that is disposed on the arrow FWD side; and a dog 565*b* that is disposed on the arrow BWD side. The dog 565*b* is an example of the "input portion" in a preferred embodiment of the present invention. An arrow FWD side portion of the sun gear 565 preferably has the shape of a cylinder that extends along the axis L2, and an outer edge of the cylindrical-shaped portion is provided with the gear 565*a*. An arrow BWD side portion of the sun gear 565 preferably has the shape of a flange that expands in a direction perpendicular or substantially perpendicular to the axis L2, and is provided with the dog 565*b* that protrudes in the arrow BWD direction from a portion near an outer edge of the flange. The dog 565*b* can be engaged with or disengaged from the dog 359*a* of the dog clutch 359. That is, when the sun gear is engaged with the dog clutch 359, the sun gear 565 is rotated in the same direction (R1 direction) as the front bevel gear 351. A thrust bearing 574 is arranged on the arrow FWD side of the flange-shaped portion of the sun gear 565. The thrust bearing 574 has a function to support the sun gear 565 and the carrier 571 for rotation in the opposite directions.

In the third preferred embodiment, as shown in FIG. 13, the sun gear 565 is meshed with the three first pinion gears 567. The three first pinion gears 567 can be rotated about the rotational shaft 569 that extends in parallel with the axis L2. The three first pinion gears 567 are meshed with the three second pinion gears 568, respectively. The three second pinion gears 568 can be rotated about the rotational shaft 570 that extends in parallel with the axis L2. As shown in FIG. 12, the rotational shafts 569 and 570 are supported by a carrier 571. A thrust bearing 575 is arranged on an arrow FWD side surface of the carrier 571. The thrust bearing 575 has a function to support the carrier 571 for rotation with respect to the lower mechanism 55. The three second pinion gears 568 are each meshed with the ring gear 566. The ring gear 566 is unrotatably fixed to the lower mechanism 55. According to this arrangement of the sun gear 565, the ring gear 566, the three first pinion gears 567, the three second pinion gears 568, and the carrier 571, it is possible to reverse the rotational direction of the carrier 571 (to the R2 direction) with respect to the rotational direction (R1 direction) of the sun gear 565. A driving force transmission path from the sun gear 565 to the carrier 571 will be described below in detail.

The carrier 571 is attached to an outer surface of the output shaft 572 on the arrow FWD side and constructed to be rotatable together with the output shaft 572. The output shaft 572 is an example of the "output portion" in a preferred embodiment of the present invention. The output shaft 572 preferably has in the shape of a cylinder. A portion of an arrow BWD side of the output shaft 565 is inserted in an opening of the sun gear 565. A dog 572*a* is disposed in the output shaft 572 on the arrow BWD side. The dog 572*a* is arranged on the outside of an outer surface of the rear propeller drive shaft 354 and constructed to be engaged with or disengaged from the front dog 358*a* of the dog clutch 358, which is positioned on the outside of the outside surface of the rear propeller drive shaft 354. A thrust bearing 576 is arranged on an arrow FWD side surface of the dog 572*a* of the output shaft 572. The thrust bearing 576 has a function to support the sun gear 565 and the output shaft 572 for rotation in the opposite directions. A thrust bearing 577 is arranged on the dog 572*a* of the output shaft 572 on the axis L2 side. The thrust bearing 577 supports the rear propeller drive shaft 354 and the output shaft 572 so that the rear propeller drive shaft 354 can stably be rotated with respect to the output shaft 572.

The other constructions of the third preferred embodiment are preferably the same as those of the second preferred embodiment.

Now, with reference to FIG. 12 and FIG. 13, description is provided about a driving force transmission path in the lower mechanism during the reverse travel of the boat according to the third embodiment. In the third preferred embodiment, description is provided of a driving force transmission path that transmits the driving force of the lower drive shaft 33 (engine 30) to the rear propeller drive shaft 354 in the case that the forward-reverse drive 363 (dog clutches 358, 359, 362) is shifted in the arrow FWD direction during the reverse travel of the boat 1.

As shown in FIG. 12, since the forward-reverse drive 363 (dog clutches 358, 359, 362) is shifted in the arrow FWD direction, the front dog 358*a* of the dog clutch 358 is engaged with the dog 572*a* of the output shaft 572, and the dog 359*a* of the dog clutch 359 is engaged with the dog 565*b* of the sun gear 565.

As described above, because the front bevel gear 351 is rotated in the R1 direction, the dog clutch 359 is rotated in the R1 direction in the same way as the front bevel gear 351. Accordingly, the sun gear 565 is rotated about the axis L2 in the R1 direction via the dog clutch 359. In the third preferred embodiment, rotation of the sun gear 565 in the R1 direction is transmitted to the three first pinion gears 567 that are meshed with the sun gear 565 and to the three second pinion gears 568. As shown in FIG. 13, the three pinion gears 567 are rotated about the rotational shaft 569 in the R4 direction in accordance with the rotation of the sun gear 565 in the R1 direction. The three second pinion gears 568 are rotated about the rotational shaft 570 in the R5 direction in accordance with the rotation of the sun gear 565 in the R1 direction. The rotation of the three first pinion gears 567 and the three second pinion gears 568 is transmitted to the ring gear 566. Since the ring gear 566 is fixed to the lower mechanism 55, the rotational shafts 569 and 570 are pressed in the R2 direction about the axis L2. Accordingly, the carrier 571 to which the rotational shafts 569 and 570 are attached is rotated in the R2 direction. That is, the rotation of the sun gear 565 in the R1 direction is converted its direction to the R2 direction in the carrier 571 by the sun gear 565, the ring gear 566, the three first pinion gears 567, three second pinion gears 568, and the carrier 571. The rotation of the carrier 571 in the R2 direction is transmitted to the output shaft 572, and the output shaft 572 is rotated about the axis L2 in the R2 direction.

Since the dog 572*a* of the output shaft 572 and the front dog 358*a* of the dog clutch 358 are engaged, the rotation of the output shaft 572 in the R2 direction is transmitted to the dog clutch 358. The dog clutch 358 is rotated in the R2 direction. The rear propeller drive shaft 354, to which the dog clutch 358 is attached, is rotated in the R2 direction.

In the case that the forward-reverse drive 363 (dog clutches 358, 359, 362) is shifted in the arrow FWD direction, a driving force transmission path, through which the driving force of the lower drive shaft 33 (engine 30) is transmitted to the front propeller drive shaft 353, is the same as the first preferred embodiment and the second preferred embodiment described above. The driving force transmission path of the case, in which the forward-reverse drive 363 (dog clutches 358, 359, 362) is shifted in the arrow BWD direction, is the same as the first preferred embodiment and the second preferred embodiment described above.

The effects and advantages of the third preferred embodiment are the same as those of the second preferred embodiment.

Fourth Preferred Embodiment

Hereinafter, construction of an outboard motor 7 according to a fourth preferred embodiment will be described below with reference to FIG. 14 to FIG. 18. In the fourth preferred embodiment, unlike the first preferred embodiment shown in FIG. 1, description is provided of an example in which a reverse drive 764 is arranged in the rear of the lower drive shaft 33.

Figure 14:
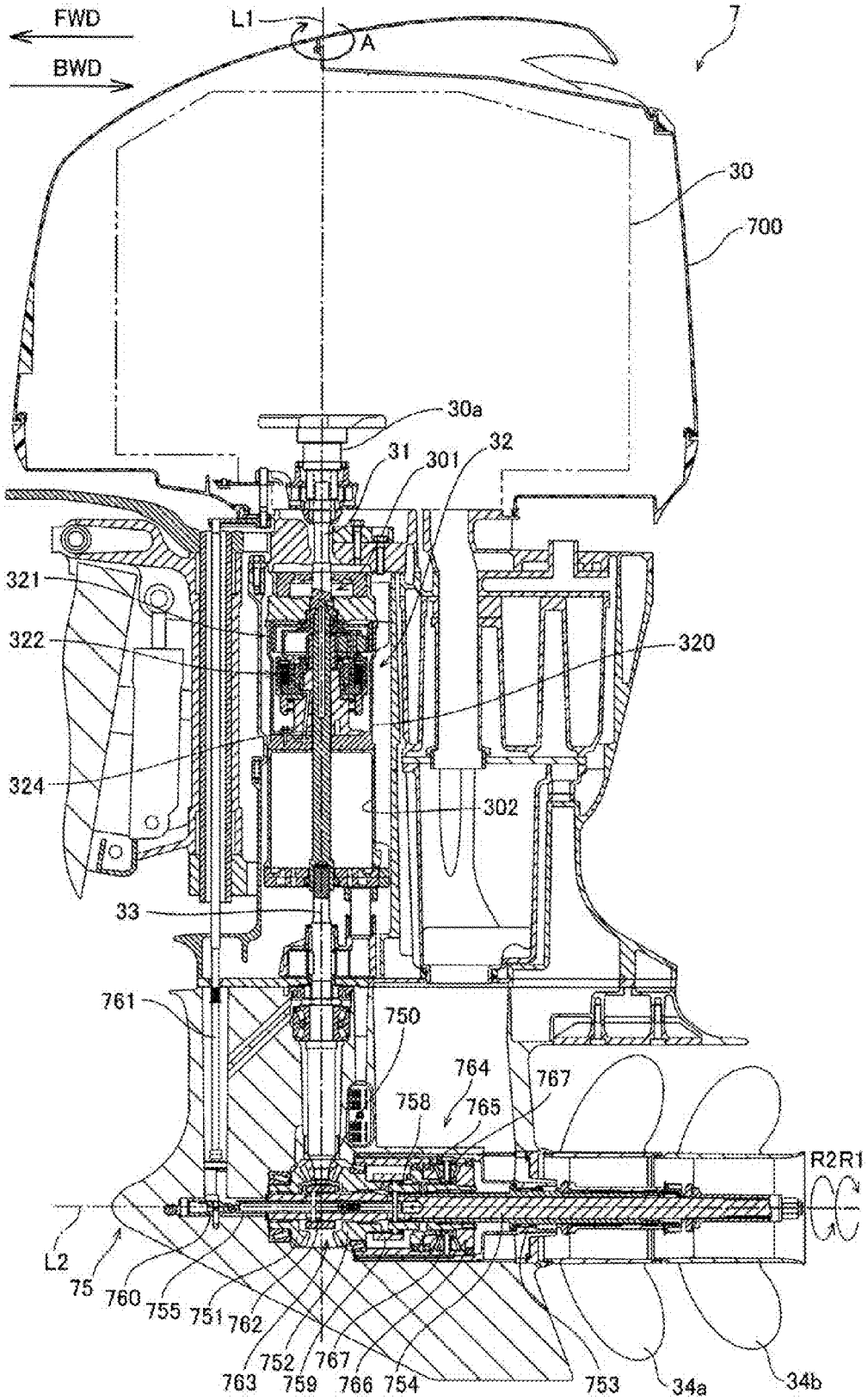
FIG. 14 is a cross-sectional view for explaining the construction of an outboard motor according to a fourth preferred embodiment of the present invention.
Figure 15:
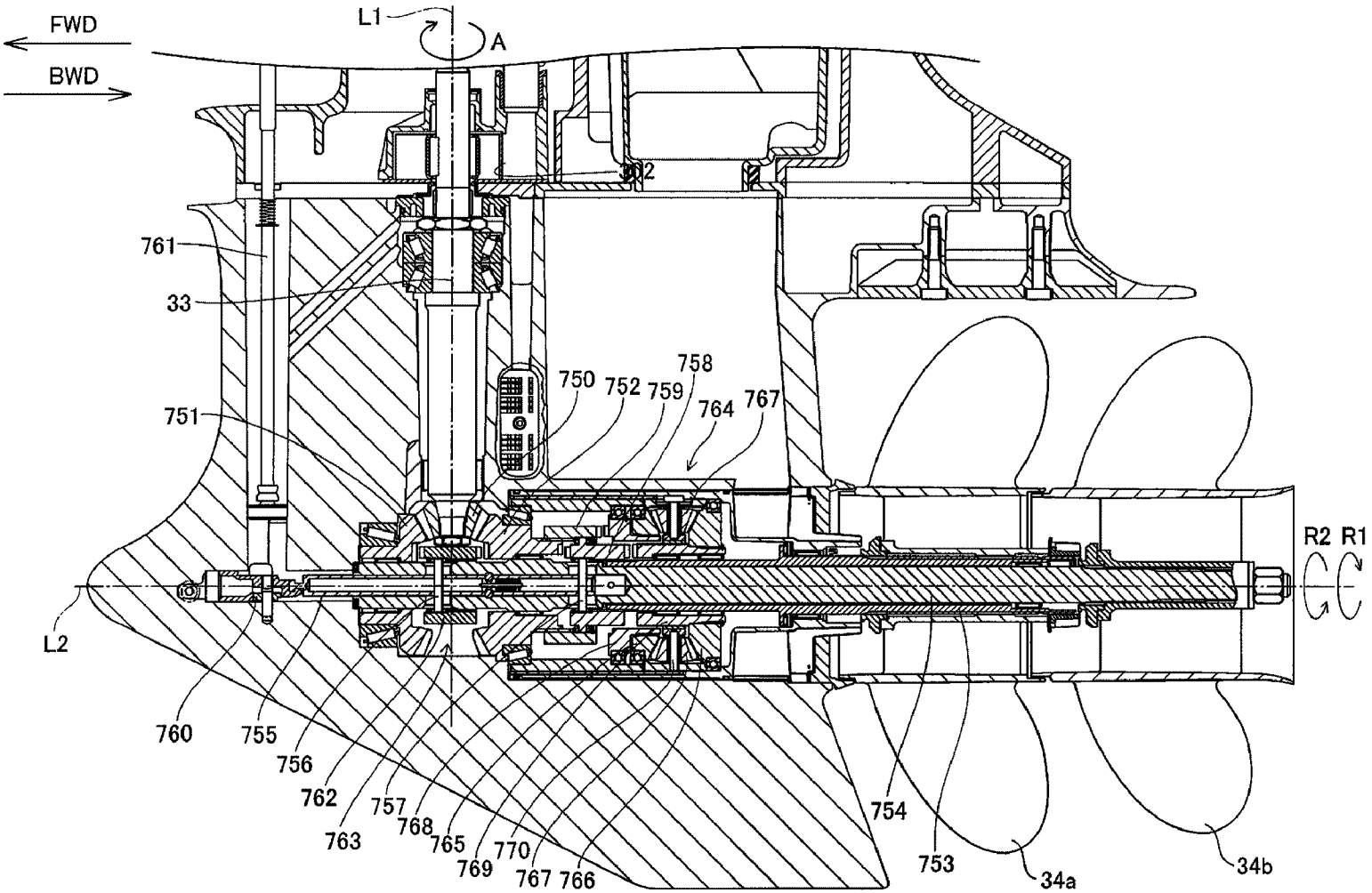
FIG. 15 is a cross-sectional view for explaining the construction of a lower mechanism of the outboard motor according to the fourth preferred embodiment of the present invention.
Figure 16:
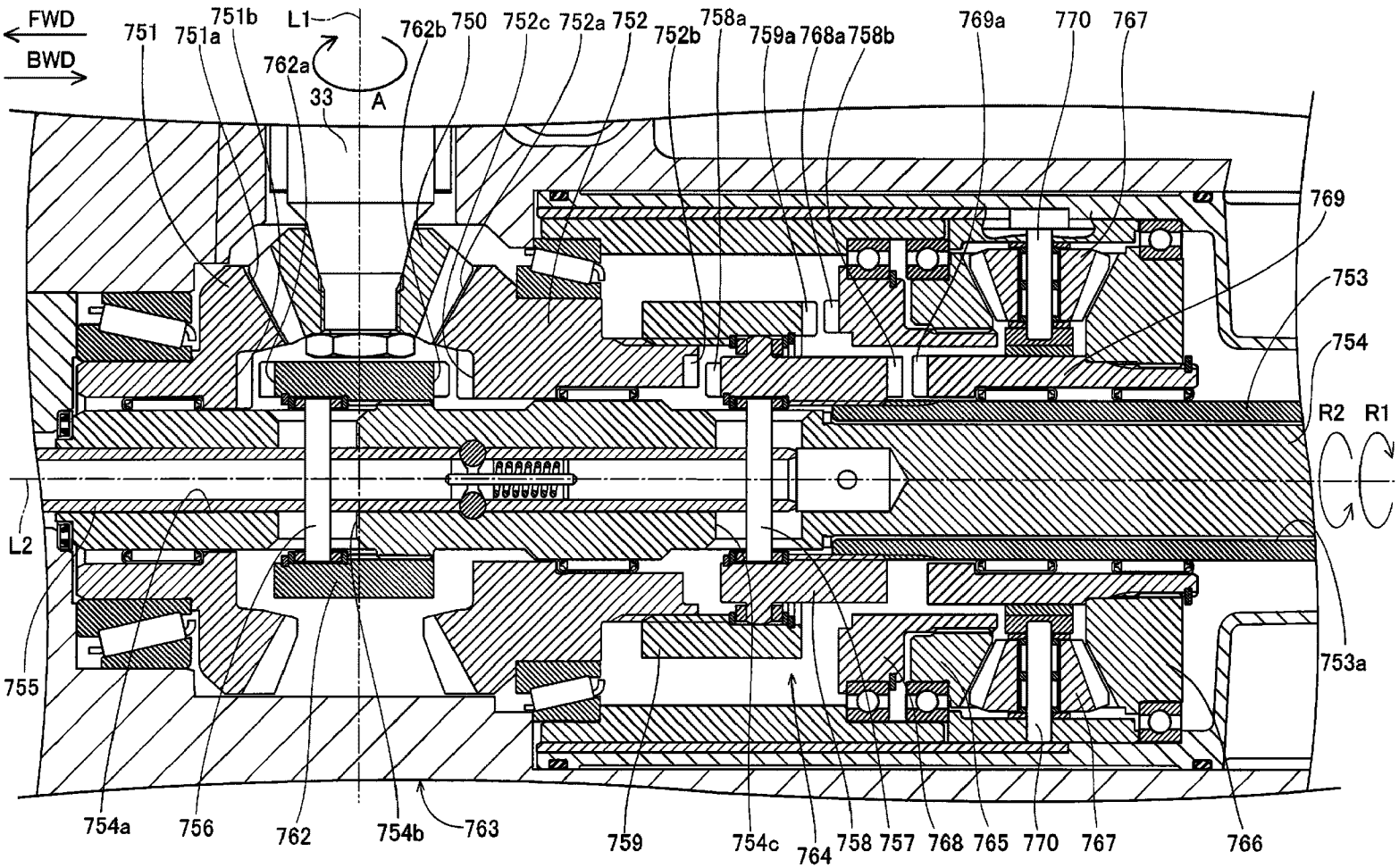
FIG. 16 is a cross-sectional view for explaining the construction of the lower mechanism of the outboard motor according to the fourth preferred embodiment of the present invention.

In the fourth preferred embodiment, as shown in FIG. 14 to FIG. 16, a lower portion of the lower drive shaft 33 is arranged in the lower mechanism 75. A bevel gear 750 is attached to the vicinity of a lower end portion (the bottom) of the lower drive shaft 33. The bevel gear 750 is an example of the "drive gear" in a preferred embodiment of the present invention. As shown in FIG. 16, the bevel gear 750 is meshed with a gear 751*a* of a front bevel gear 751 arranged below in the arrow FWD direction, and is also meshed with a gear 752*a* of a rear bevel gear 752 arranged below in the arrow BWD direction. The front bevel gear 751 is an example of "second bevel gear" of a preferred embodiment of the present invention, and the rear bevel gear 752 is an example of "first bevel gear" of a preferred embodiment of the present invention. The axis L2 around which the front bevel gear 751 and the rear bevel gear 752 are rotated is perpendicular or substantially perpendicular to the axis L1 (refer to FIG. 14) around which the bevel gear 750 is rotated. The axis L2 extends in the arrow FWD direction.

The dog 751*b*, which can be engaged with or disengaged from a dog clutch 762 described below, is disposed in a portion of the front bevel gear 751 on the arrow BWD side that is adjacent to a axis L2 side. A dog 752*b*, which can be engaged with or disengaged from a dog clutch 758 described below, is disposed in an arrow BWD side end portion of the rear bevel gear 752. A dog clutch 759 described below is engaged with an outer edge of the rear bevel gear 752 in the arrow BWD direction in a way that the dog clutch 759 can be slid in the fore-and-aft direction. The dog 752*c*, which can be engaged with or disengaged from a dog clutch 762 described below, is disposed in a portion of the rear bevel gear 752 on the arrow FWD side that is adjacent to the axis L2 side.

In the fourth preferred embodiment, a front propeller drive shaft 753 and a rear propeller drive shaft 754, which extend in the direction perpendicular or substantially perpendicular to the lower drive shaft 33, are disposed below the lower drive shaft 33. The front propeller drive shaft 753 is an example of "first shaft" in a preferred embodiment of the present invention, and the rear propeller drive shaft 754 is an example of "second shaft" in a preferred embodiment of the present invention. The front propeller drive shaft 753 and the rear propeller drive shaft 754 are constructed to be rotatable in a different direction from each other. The front propeller drive shaft 753 is arranged to rotate about the axis L2, and is formed in the hollow (cylindrical) shape along the axis L2. As shown in FIG. 15, on the arrow BWD side (one side) of the front propeller drive shaft 753, the front propeller 34*a* is attached to be rotatable with the front propeller drive shaft 753. As shown in FIG. 16, on the periphery of the arrow FWD side (another side) of the front propeller drive shaft 753, a dog clutch 758 described below is engaged so as to be slidable in the fore-and-aft direction.

In the fourth preferred embodiment, a rear propeller drive shaft 754 is inserted in a hollow portion 753*a* along the axis L2 of the front propeller drive shaft 753. In the same way as the front propeller drive shaft 754, the rear propeller drive shaft 753 is arranged to rotate about the axis L2. As shown in FIG. 14, the rear propeller drive shaft 754 is longer than the front propeller drive shaft 753 in the fore-and-aft direction. An end portion of the rear propeller drive shaft 754 in the arrow FWD direction is arranged to protrude in the arrow FWD direction from an end portion of the front propeller drive shaft 753 in the arrow FWD direction. Also, an end portion of the rear propeller drive shaft 754 in the arrow BWD direction is arranged to protrude in the arrow BWD direction from an end portion of the front propeller drive shaft 753 in the arrow BWD direction. As shown in FIG. 15, on the arrow BWD side (one side) of the rear propeller drive shaft 754, the rear propeller 34*b* described above is attached to be rotatable together with the rear propeller drive shaft 754. As shown in FIG. 16, on the arrow FWD side (another side) of the rear propeller drive shaft 754, the front bevel gear 751 and the rear bevel gear 752 are both arranged so as to idle with respect to the rear propeller drive shaft 754. On the periphery of the arrow FWD side (another side) of the rear propeller drive shaft 754, the dog clutch 762 described below is spline-fitted so as to be slidable in the fore-and-aft direction.

An insertion hole 754*a* along the axis L2 is formed on the arrow FWD side of the rear propeller drive shaft 754. An outer surface of the rear propeller drive shaft 754 on the arrow FWD side is formed with a through hole 754*b* and a through hole 754*c* which are perpendicular or substantially perpendicular to the insertion hole 754*a*. The through holes 754*b* and 754*c* preferably have the shape of a slot that extends in the fore-and-aft direction (in the arrow FWD direction and arrow BWD direction).

In the insertion hole 754*a* along the axis L2 of the rear propeller drive shaft 754, a connecting member 755 in the shape of a cylinder is inserted so as to be slidable in the fore-and-aft direction (in the arrow FWD direction and arrow BWD direction). To a portion corresponding to the through hole 754*b* of the connecting member 755, the connecting member 756 in a rod shape is attached so as to be perpendicular or substantially perpendicular to the connecting member 755. The connecting member 756 is arranged to protrude outside from an outer surface of the rear propeller drive shaft 754. The connecting member 755 is slid along the through hole 754*b* in the shape of a slot in the fore-and-aft direction when the connecting member 755 is slid along the insertion hole 754*a*. To a portion corresponding to the through hole 754*c* of the connecting member 755, the connecting member 757 in the rod shape is attached so as to be perpendicular or substantially perpendicular to the connecting member 755. The connecting member 757 is arranged so as to protrude outside from an outer surface of the rear propeller drive shaft 754. The connecting member 755 is slid in the fore-and-aft direction on the through hole 754*c* in the shape of a slot when the connecting member 755 is slid along the insertion hole 754*a*.

Figure 17:
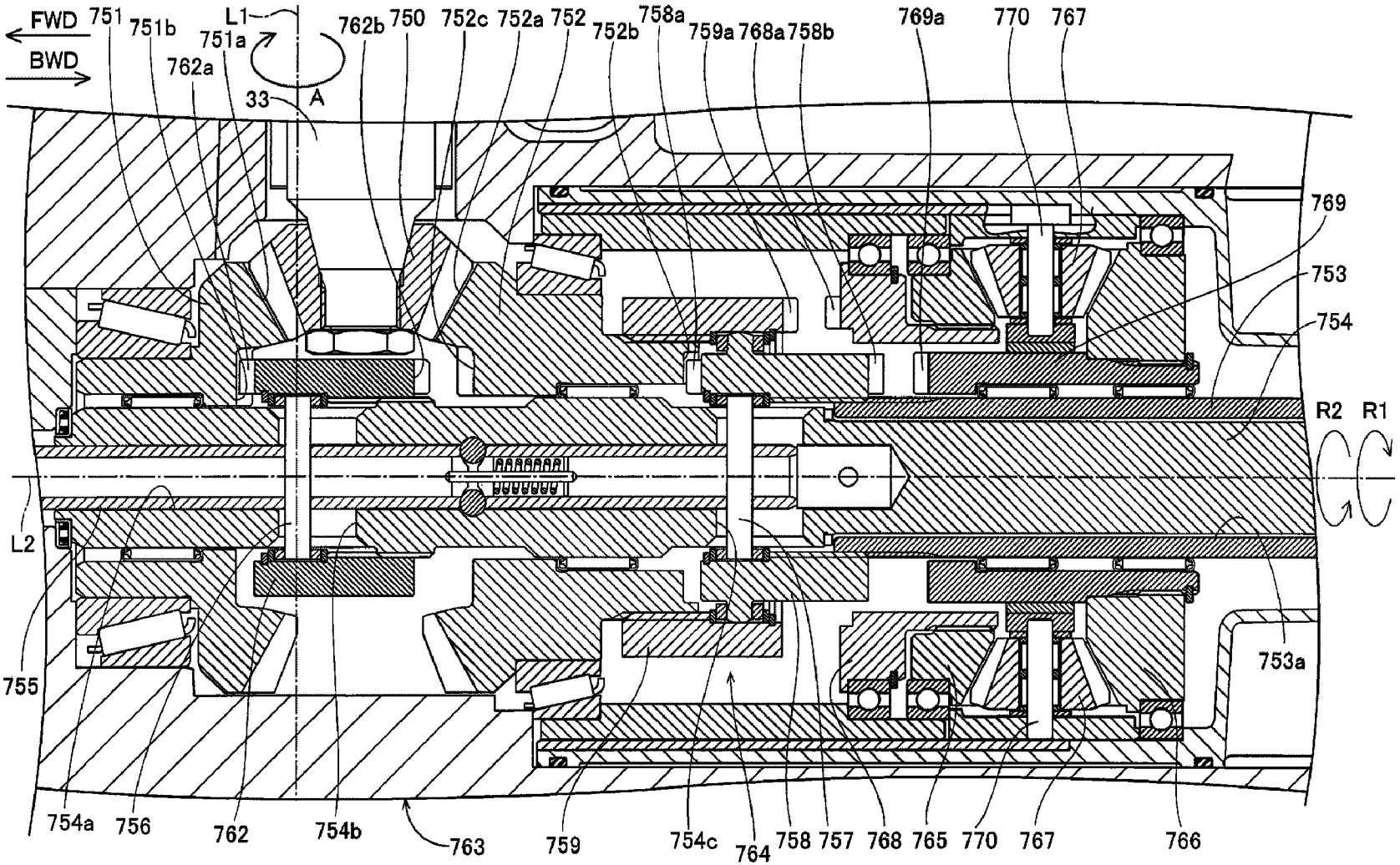
FIG. 17 is a cross-sectional view for explaining the construction of the lower mechanism of the outboard motor according to the second preferred embodiment of the present invention.
Figure 18:
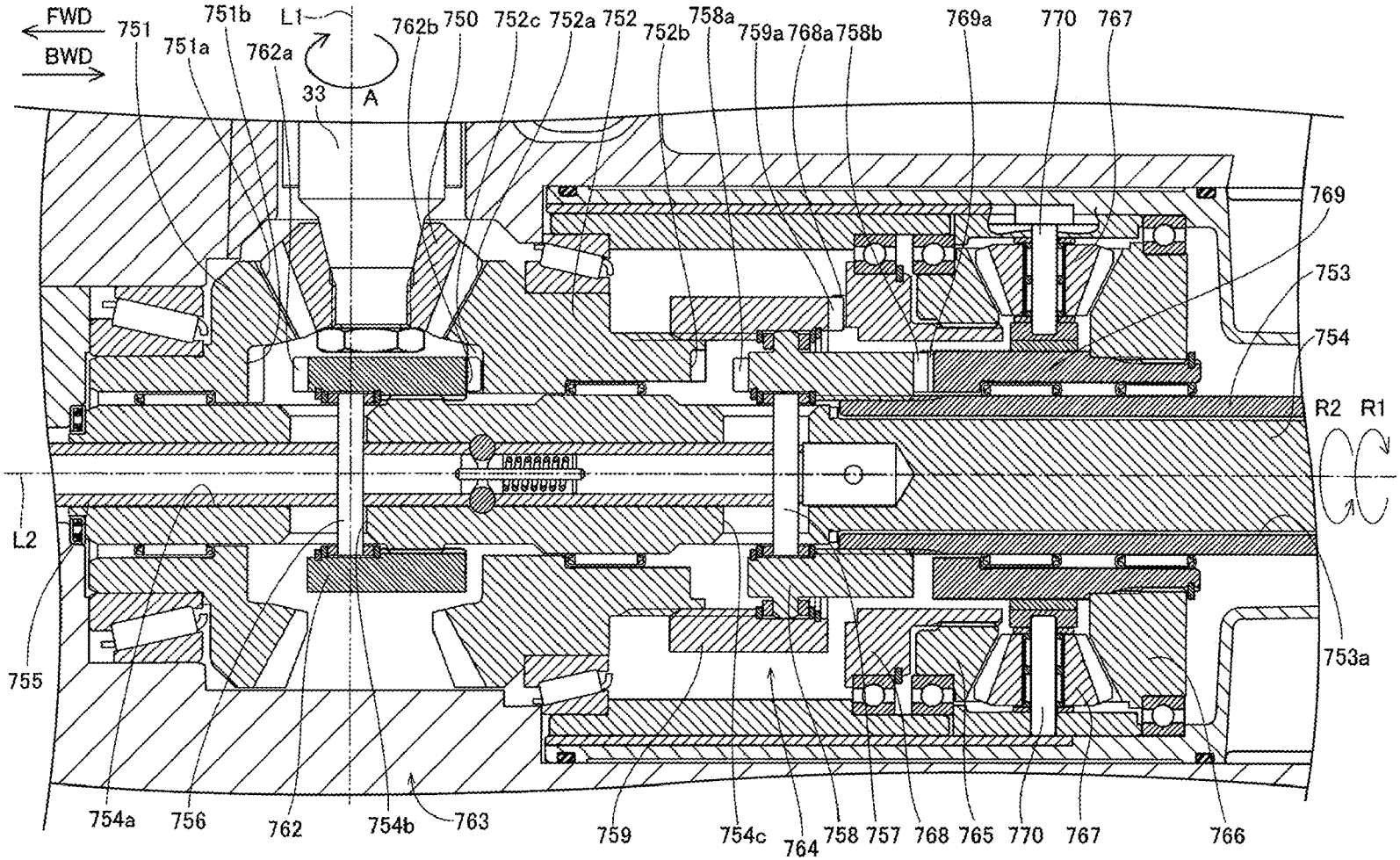
FIG. 18 is a cross-sectional view for explaining the construction of the lower mechanism of the outboard motor according to the second preferred embodiment of the present invention.

In the fourth preferred embodiment, a dog clutch 762 is rotatably attached to the connecting member 756. The dog clutch 762 is an example of the "fourth clutch" in a preferred embodiment of the present invention. The dog clutch 762 is attached to an outer surface of the rear propeller drive shaft 754 preferably by spline-fitting, so that the dog clutch 368 can slide with respect to the rear propeller drive shaft 754 as described above, and can also rotate together with the rear propeller drive shaft 754. That is, the dog clutch 762 is constructed to rotate with the rear propeller drive shaft 754 at all times. A front dog 762*a* is disposed in an end portion of the dog clutch 762 on the arrow FWD side. Also, a rear dog 762*b* is disposed in an end portion of the dog clutch 762 on the arrow BWD side. As shown in FIG. 17, when the dog clutch 762 is slid in the arrow FWD direction, the front dog 762*a* is engaged with a dog 751*b* of the front bevel gear 751. On the other hand, as shown in FIG. 18, when the dog clutch 762 is slid in the arrow BWD direction, the rear dog 762*b* is engaged with the dog 752*c* of the rear bevel gear 752. That is, as shown in FIG. 17, when the dog clutch 762 is engaged with the front bevel gear 751, rotation of the front bevel gear 751 is directly transmitted to the rear propeller drive shaft 754. On the other hand, as shown in FIG. 18, when the dog clutch 762 is engaged with the rear bevel gear 752, rotation of the rear bevel gear 752 is directly transmitted to the rear propeller drive shaft 754. As shown in FIG. 16, when the dog clutch 762 is in a neutral position where the dog clutch 762 is not engaged either with the front bevel gear 751 or with the rear bevel gear 752, driving force of the bevel gear 750 is not transmitted to the front propeller drive shaft 753 and the rear propeller drive shaft 754.

In the fourth preferred embodiment, the dog clutch 758 is rotatably attached to the connecting member 757, and the dog clutch 759 is rotatably attached to the dog clutch 758. The dog clutch 758 is an example of the "fifth clutch" in a preferred embodiment of the present invention, and the dog clutch 759 is an example of the "sixth clutch" in a preferred embodiment of the present invention.

The dog clutch 758 is attached to an outer surface of the front propeller drive shaft 753 preferably by spline-fitting, so that the dog clutch 758 can be slid with respect to the front propeller drive shaft 753 and can be rotated together with the front propeller drive shaft 753. That is, the dog clutch 758 is constructed to rotate together with the front propeller drive shaft 753 at all times. A front dog 758*a* is disposed in the dog clutch 758 on the arrow FWD side. Also, a rear dog 758*b* is disposed in the dog clutch 758 on the arrow BWD side. As shown in FIG. 17, when the dog clutch 758 is slid in the arrow FWD direction, the front dog 758*a* is engaged with a dog 752*b* of the rear bevel gear 752. On the other hand, as shown in FIG. 18, when the dog clutch 758 is slid in the arrow BWD direction, the rear dog 758*b* is engaged with a dog 769*a* of an output shaft 769 of a reverse drive 764 described below. That is, as shown in FIG. 17, the dog clutch 758 has a function that when the front dog 758*a* is engaged with the dog 752*b* of the rear bevel gear 752, rotation of the rear bevel gear 752 is directly transmitted to the front propeller drive shaft 753. On the other hand, as shown in FIG. 18, when the rear dog 758*b* is engaged with the dog 769*a* of the output shaft 769 described below, the dog clutch 758 transmits the rotation of the output shaft 769 of the reverse drive 764 to the front propeller drive shaft 753. As shown in FIG. 16, when the dog clutch 758 is in a neutral position where the dog clutch 758 is not engaged either with the rear bevel gear 752 or with the output shaft 769 described below, the driving force of the bevel gear 750 is not transmitted to the front propeller drive shaft 753 and the rear propeller drive shaft 754.

In the fourth preferred embodiment, the dog clutch 759 is arranged to cover an outer surface of the dog clutch 758 on the arrow FWD side and constructed to be slid in the fore-and-aft direction together with the dog clutch 758. The dog clutch 759 is attached to an outer surface of the rear bevel gear 752 preferably by spline-fitting, so that the dog clutch 759 can be slid with respect to the rear bevel gear 752 and can be rotated together with the rear bevel gear 752. That is, the dog clutch 759 is rotated together with the rear bevel gear 752 at all times. A dog 759*a* is disposed in an end portion of the dog clutch 759 on the arrow BWD side. As shown in FIG. 17, when the dog clutch 759 is slid in the arrow FWD direction, the dog 759*a* is engaged with a dog 768*a* of the input shaft 768 described below. On the other hand, as shown in FIG. 18, when the dog clutch 759 is slid in the arrow BWD direction, the dog 759*a* is disengaged from the dog 768*a* of the input shaft 768. That is, when the dog clutch 758 is engaged with the input shaft 768 of the reverse drive 764 described below, the rotation of the rear bevel gear 752 is transmitted to the input shaft 768.

As shown in FIG. 15, a forward-reverse switching lever 760 is attached to the arrow FWD side of the connecting member 755. As shown in FIG. 14, the forward-reverse switching lever 760 is connected with an actuator (not shown) arranged in a case 700 (refer to FIG. 14) via a linkage 761. The forward-reverse switching lever 760 is rotated in accordance with the rotation of the linkage 761.

As described above, the dog clutches 762, 758, and 759 can be shifted together in the fore-and-aft direction (arrow FWD direction and arrow BWD direction) in accordance with the rotation of the forward-reverse switching lever 760. In the fourth preferred embodiment, the forward-reverse drive 763 is constructed with the connecting members 755, 756, and 757, and the dog clutches 758, 759, and 762. The forward-reverse drive 763 is arranged on the axis L2 and driven during the forward travel and reverse travel of the boat 1.

In the fourth preferred embodiment, the reverse drive 764, which is driven during the reverse travel, is disposed in the forward-reverse drive 763 on the axis L2 on the arrow BWD side. The forward-reverse drive 763 and the reverse drive 764 are an example of "forward-reverse switching mechanism" in a preferred embodiment of the present invention. The reverse drive 764 preferably includes: a bevel gear 765 and a bevel gear 766 that can be rotated about the axis L2; a plurality of bevel gears 767 that is arranged between the bevel gear 765 and the bevel gear 766; the input shaft 768 that is attached to the bevel gear 765 and that can be connected with the dog clutch 759; the output shaft 769 that is attached to the bevel gear 766 and that can be connected with the dog clutch 758.

The bevel gear 765 preferably is spline-fitted to an outer surface of the input shaft 768 in the arrow FWD side and is constructed to be rotatable with the input shaft 768. The input shaft 768 preferably has a hollow shape along the axis L2. The dog 768*a* is disposed in an end portion of the input shaft 768 on the arrow FWD side. The dog 768*a* can be engaged with or disengaged from the dog 759*a* of the dog clutch 759. In other words, as shown in FIG. 17, the bevel gear 765 is rotated in the same direction (R2 direction) as the rear bevel gear 752 when the input shaft 768 is engaged with the dog clutch 759.

As shown in FIG. 16, the bevel gear 765 is meshed with the plurality of bevel gears 767. The plurality of bevel gears 767 are each rotatably supported by a rotational shaft 770 that extends in a direction perpendicular or substantially perpendicular to the bevel gear 765. The plurality of bevel gears 767 are each meshed with the bevel gear 766. According to the arrangement of the bevel gears 765, 766, and 767, it is possible to reverse the rotational direction (R1 direction) of the bevel gear 766 with respect to the rotational direction (R2 direction) of the bevel gear 765. The bevel gear 766 preferably is spline-fitted to an outer surface of the output shaft 769 and can be rotated together with the output shaft 769. The output shaft 769 is in the shape of a cylinder and inserted in an opening of the input shaft 768 so as to be rotatable with respect to the input shaft 768. A dog 769*a* is disposed in an end portion of the output shaft 769 on the arrow FWD side. The dog 769*a* can be engaged with or disengaged from the rear dog 758*b* of the dog clutch 758.

The other constructions of the fourth preferred embodiment are preferably the same as those of the first preferred embodiment.

Now, a driving force transmission path in the lower mechanism 75 is described in detail. First, description is provided of the driving force transmission path during the forward travel when the forward-reverse drive 763 (dog clutches 758, 759, 762) is shifted in the arrow FWD direction.

In accordance with the rotation of the lower drive shaft 33 in the A direction, the bevel gear 750 attached to the vicinity of a lower end portion of the lower drive shaft 33 is rotated in the A direction. In accordance with the rotation of the bevel gear 750 in the A direction, the front bevel gear 751 is rotated in the R1 direction, and the rear bevel gear 752 is rotated in the R2 direction.

Now, while referring to FIG. 15 and FIG. 17, description is provided of a driving force transmission path, which transmits the driving force of the lower drive shaft 33 (engine 30) to the rear propeller drive shaft 754 in the case that the forward-reverse drive 763 (dog clutches 758, 759, 762) is shifted in the arrow FWD direction. As shown in FIG. 17, since the forward-reverse drive 763 (dog clutches 758, 759, 762) is shifted in the arrow FWD direction, the front dog 762*a* of the dog clutch 762 is engaged with the dog 751*b* of the front bevel gear 751. Accordingly, the rotation of the front bevel gear 751 in the R1 direction is transmitted to the dog clutch 762, and the dog clutch 762 is rotated in the R1 direction. Since the dog clutch 762 is attached to the rear propeller drive shaft 754, the rear propeller drive shaft 754 is rotated in the R1 direction. As a result, the rear propeller 34*b* is rotated in the R1 direction, as shown in FIG. 15.

Now, while referring to FIG. 15 and FIG. 17, description is provided of a driving force transmission path that transmits the driving force of the lower drive shaft 33 (engine 30) to the front propeller drive shaft 753 in the case that the forward-reverse drive 763 (dog clutches 758, 759, 762) is shifted in the arrow FWD direction. As shown in FIG. 17, since the forward-reverse drive 763 (dog clutches 758, 759, 762) is shifted in the arrow FWD direction, the front dog 758*a* of the dog clutch 758 is engaged with the dog 752*b* of the rear bevel gear 752. Thus, the dog clutch 758 is rotated in the R2 direction in accordance with the rotation of the rear bevel gear 752 in the R2 direction. Since the dog clutch 758 is integrally rotated with the front propeller drive shaft 753, the front propeller drive shaft 753 is rotated together with the dog clutch 758 in the R2 direction. As a result, the front propeller 34*a* is rotated in the R2 direction as shown in FIG. 15.

As described above, when the forward-reverse drive 763 (dog clutches 758, 759, 762) is shifted in the arrow FWD direction, the rear propeller 34*b* is rotated in the R1 direction, and the front propeller 34*a* is rotated in the R2 direction. As a result, the boat (not shown) is propelled (advanced) in the arrow FWD direction.

Now, with reference to FIG. 15 and FIG. 18, description is provided of a driving force transmission path, which transmits the driving force of the lower drive shaft 33 (engine 30) to the rear propeller drive shaft 754 in the case that the forward-reverse drive 763 (dog clutches 758, 759, 762) is shifted in the arrow BWD direction when the boat is propelled in reverse. As shown in FIG. 18, since the forward-reverse drive 763 (dog clutches 758, 759, 762) is shifted in the arrow BWD direction, the rear dog 762*b* of the dog clutch 762 is engaged with the dog 752*c* of the rear bevel gear 752. Since the rear bevel gear 752 is rotated in the R2 direction, the dog clutch 762 is rotated in the R2 direction together with the rear bevel gear 752. Accordingly, the rear propeller drive shaft 754 is rotated in the R2 direction via the dog clutch 762. As a result, the rear propeller 34*b* is rotated in the R2 direction as shown in FIG. 15.

Now, with reference to FIG. 15 and FIG. 18, description is provided of a driving force transmission path, which transmits the driving force of the lower drive shaft 33 (engine 30) to the front propeller drive shaft 753, in the case that the forward-reverse drive 763 (dog clutches 758, 759, 762) is shifted in the arrow BWD direction. As shown in FIG. 18, since the forward-reverse drive 763 (dog clutches 758, 759, 762) is shifted in the arrow BWD direction, the rear dog 758*b* of the dog clutch 758 is engaged with the dog 769*a* of the output shaft 769, and the dog 759*a* of the dog clutch 759 is engaged with the dog 768*a* of the input shaft 768.

Since the rear bevel gear 752 is rotated in the R2 direction, the dog clutch 759 is rotated together with the rear bevel gear 752 in the R2 direction. Accordingly, the input shaft 768 is rotated in the R2 direction via the dog clutch 759. Since the bevel gear 765 is attached to the input shaft 768, the bevel gear 765 is rotated about the axis L2 in the R2 direction.

In the fourth preferred embodiment, the rotation of the bevel gear 765 in the R2 direction is transmitted to the plurality of bevel gears 767 that are meshed with the bevel gear 765. The plurality of bevel gears 767 is rotated about the rotational shaft 770 in a C direction in accordance with the rotation of the bevel gear 765 in the R2 direction. The rotation of the plurality of bevel gears 767 in the C direction is transmitted to the bevel gear 766. The bevel gear 766 is rotated about the axis L2 in the R1 direction in accordance with the rotation of the plurality of bevel gears 767 in the C direction. That is, the rotation of the bevel gear 765 in the R2 direction is converted its direction to the R1 direction in the bevel gear 766 by the bevel gear 767. The rotation of the bevel gear 766 in the R1 direction is transmitted to the output shaft 769, and the output shaft 769 is rotated about the axis L2 in the R1 direction.

Since the dog 769*a* of the output shaft 769 and the rear dog 758*b* of the dog clutch 758 are engaged, the rotation of the output shaft 769 in the R1 direction is transmitted to the dog clutch 758. The dog clutch 758 is rotated in the R1 direction. The front propeller drive shaft 753 to which the dog clutch 758 is attached is rotated in the R1 direction. As a result, the front propeller 34*a* is rotated in the R1 direction as shown in FIG. 15.

As described above, when the forward-reverse drive 763 (dog clutches 758, 759, 762) is shifted in the arrow BWD direction, the rear propeller 34*b* is rotated in the R2 direction, and the front propeller 34*a* is rotated in the R1 direction. As a result, the boat (not shown) is propelled (reversed) in the arrow BWD direction.

In the fourth preferred embodiment, as described above, since the forward-reverse drive 763 is provided with the dog clutch 762 that is engaged during the forward travel and reverse travel and that transmits the driving force of the engine 30 to the rear propeller drive shaft 754, the driving force of the engine 30 can easily be connected with or disconnected from the rear propeller drive shaft 754. Also, since the forward-reverse drive 763 is provided with the dog clutch 758 that is engaged during the forward travel and reverse travel and that transmits the driving force of the engine 30 to the front propeller drive shaft 753, and the dog clutch 759 that is engaged during the reverse travel and that transmits the driving force of the engine 30 to the reverse drive 764, the driving force of the engine 30 can easily be connected with or disconnected from the reverse drive 764 and the front propeller drive shaft 753.

In the fourth preferred embodiment, as described above, when the boat is propelled forward, the front bevel gear 751 is engaged with the rear propeller drive shaft 754 by the dog clutch 762 to rotate the rear propeller drive shaft 754 in the R1 direction, and the rear bevel gear 752 is engaged with the front propeller drive shaft 753 by the dog clutch 758 to rotate the front propeller drive shaft 753 in the R2 direction. Accordingly, the rear propeller drive shaft 754 can easily be rotated in the R1 direction by the dog clutch 762, and the front propeller drive shaft 753 can easily be rotated in the R2 direction by the dog clutch 758.

In the fourth preferred embodiment, as described above, when the boat is propelled in reverse, the rear bevel gear 752 is engaged with the rear propeller drive shaft 754 by the dog clutch 762 to rotate the rear propeller drive shaft 754 in the R2 direction, and the rear bevel gear 752 is engaged with the reverse drive 764 by the dog clutch 759, and the reverse drive 764 is engaged with the front propeller drive shaft 753 by the dog clutch 758 to rotate the front propeller drive shaft 753 in the R2 direction. Accordingly, the rear propeller drive shaft 754 can easily be rotated in the R2 direction by the dog clutch 762, and the front propeller drive shaft 753 can easily be rotated in the R1 direction by the dog clutch 758 and the dog clutch 759.

Note that the preferred embodiments disclosed in this specification are merely examples in every aspect, and it should not be considered to limit the present invention to the particular preferred embodiments described above. The scope of the present invention is not defined by the aforementioned description of the preferred embodiments, but by the claims. Also the scope of the present invention includes every modification within the equivalent meaning and scope of the claims.

For example, in the above described preferred embodiments, the boat propulsion unit preferably includes two outboard motors in which the engine and the propeller are arranged outside the hull. However, the present invention is not limited thereto, and may be applied to other boat propulsion units that include a stern drive with the engine fixed to the hull, an inboard motor with the engine and the propeller fixed to the hull, or the like.

In the above preferred embodiments, the outboard motor is preferably provided with two propellers. However, the present invention is not limited to thereto. The outboard motor may be provided with three or more propellers.

In the preferred embodiments described above, switching between the forward travel and the reverse travel of the boat preferably is performed by three dog clutches. However, the present invention is not limited thereto. Switching between the forward travel and the reverse travel may be performed by clutches other than a dog clutch such as one, two, four or more wet-type multi-plate clutches. The forward travel and the reverse travel of the boat may be switched by one or two dog clutches, or may be switched by four or more dog clutches.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion unit comprising:

an engine;

a drive shaft arranged to extend below the engine;

a first shaft and a second shaft arranged to extend in a direction intersecting with the drive shaft;

a first propeller disposed on the first shaft and arranged to rotate together with the first shaft during both of forward travel and reverse travel of a boat;

a second propeller disposed on the second shaft and arranged to rotate together with the second shaft in an opposite direction of the first propeller during both of the forward travel and the reverse travel of the boat; and a forward-reverse switching mechanism arranged on an axis of the first shaft and the second shaft and arranged to switch between a direction in which the first shaft and the second shaft are rotated during the forward travel of the boat, and a direction in which the first shaft and the second shaft are rotated during the reverse travel of the boat; wherein the forward-reverse switching mechanism includes a forward-reverse drive arranged to be driven during both of the forward travel and the reverse travel of the boat, and a reverse drive arranged to be driven during the reverse travel of the boat; and the second propeller is disposed on a first end of the second shaft, and the reverse drive is arranged on a second end of the second shaft.

2. The boat propulsion unit according to claim 1, wherein the forward-reverse drive of the forward-reverse switching mechanism includes:

a first clutch arranged to be engaged during the forward travel and the reverse travel of the boat and to transmit a driving force of the engine to the first shaft;

a second clutch arranged to be engaged during the forward travel and the reverse travel of the boat and to transmit a driving force of the engine to the second shaft; and a third clutch arranged to be engaged during the reverse travel of the boat and to transmit a driving force of the engine to the reverse drive.

3. The boat propulsion unit according to claim 2, further comprising:

a drive gear disposed below the drive shaft;

a first bevel gear arranged to be meshed with the drive gear and to rotate in a first direction in accordance with rotation of the drive gear; and a second bevel gear arranged to be meshed with the drive gear and to rotate in a second direction opposite to the first direction in accordance with rotation of the drive gear; wherein when the boat is propelled forward, the first bevel gear is engaged with the first shaft by the first clutch to rotate the first shaft in the first direction, and the second bevel gear is engaged with the second shaft by the second clutch to rotate the second shaft in the second direction.

4. The boat propulsion unit according to claim 3, wherein when the boat is propelled in reverse, the second bevel gear is engaged with the first shaft by the first clutch to rotate the first shaft in the second direction, the second bevel gear is engaged with the reverse drive by the third clutch, and the reverse drive is engaged with the second shaft by the second clutch to rotate the second shaft in the first direction.

5. The boat propulsion unit according to claim 4 wherein the reverse drive includes an input portion arranged to be engaged with the second bevel gear via the third clutch and to rotate in the second direction which is a same rotational direction as the second bevel gear, when the boat is propelled in reverse; and an output portion arranged to be engaged with the second shaft via the second clutch and to rotate in the first direction which is an opposite rotational direction of the second bevel gear, when the water craft is propelled in reverse.

6. The boat propulsion unit according to claim 5, wherein the reverse drive is constructed such that the output portion is rotated in the first direction which is opposite of a rotational direction of the second bevel gear that is input to the input portion by a combination of a plurality of bevel gears.

7. The boat propulsion unit according to claim 6, wherein the reverse drive includes:

a third bevel gear that defines the input portion with which the third clutch is engaged, and arranged to rotate in the second direction which is a same rotational direction as the second bevel gear;

a fourth bevel gear arranged to be meshed with the third bevel gear and to rotate in an opposite direction of a rotational direction of the drive shaft;

a fifth bevel gear arranged to be meshed with the fourth bevel gear and to rotate in the first direction which is an opposite rotational direction of the third bevel gear; and an output shaft provided with the fifth bevel gear, that defines the output portion to which the second clutch is engaged, and arranged to rotate in the first direction together with the fifth bevel gear.

8. The boat propulsion unit according to claim 5 wherein the reverse drive is constructed such that the output portion is rotated in the first direction which is opposite of a rotational direction of the second bevel gear that is input to the input portion by using a planetary gear mechanism.

9. The boat propulsion unit according to claim 2, further comprising a forward-reverse switching lever arranged to be shifted to engage or disengage the first clutch, the second clutch, and the third clutch.

10. The boat propulsion unit according to claim 1, wherein the reverse drive is constructed such that a driving force of the engine is not transmitted when the boat is propelled forward.

11. The boat propulsion unit according to claim 1, wherein the forward-reverse drive of the forward-reverse switching mechanism includes:

a first clutch arranged to be engaged during the forward travel and the reverse travel of the boat and to transmit a driving force of the engine to the second shaft;

a second clutch arranged to be engaged during the forward travel and the reverse travel of the boat and to transmit a driving force of the engine to the first shaft; and a third clutch arranged to be engaged during the reverse travel of the boat and to transmit a driving force of the engine to the reverse drive.

12. The boat propulsion unit according to claim 11, further comprising:

a drive gear disposed below the drive shaft;

a first bevel gear arranged to be meshed with the drive gear and to rotate in a first direction in accordance with rotation of the drive gear; and a second bevel gear arranged to be meshed with the drive gear and to rotate in a second direction which is opposite of the first direction in accordance with rotation of the drive gear; wherein the second bevel gear and the second shaft are engaged by the first clutch to rotate the second shaft in the second direction when the boat is propelled forward, and the first bevel gear and the first shaft are engaged by the second clutch to rotate the first shaft in the first direction when the boat is propelled forward.

13. The boat propulsion unit according to claim 12, wherein, when the boat is propelled in reverse, the first bevel gear is engaged with the second shaft by the first clutch to rotate the second shaft in the first direction, the first bevel gear is engaged with the reverse drive by the third clutch, and the reverse drive is engaged with the first shaft by the second clutch to rotate the first shaft in the second direction.

14. A boat propulsion unit comprising:

an engine;

a drive shaft arranged to extend below the engine;

a first shaft and a second shaft arranged to extend in a direction intersecting with the drive shaft;

a first propeller disposed on the first shaft and arranged to rotate together with the first shaft during both of forward travel and reverse travel of a boat;

a second propeller disposed on the second shaft and arranged to rotate together with the second shaft in an opposite direction of the first propeller during both of the forward travel and the reverse travel of the boat; and a forward-reverse switching mechanism arranged on an axis of the first shaft and the second shaft and arranged to switch between a direction in which the first shaft and the second shaft are rotated during the forward travel of the boat, and a direction in which the first shaft and the second shaft are rotated during the reverse travel of the boat; wherein the forward-reverse switching mechanism includes a forward-reverse drive arranged to be driven during both of the forward travel and the reverse travel of the boat, and a reverse drive arranged to be driven during the reverse travel of the boat; and the reverse drive is constructed such that a driving force of the engine is not transmitted when the boat is propelled forward.

15. A boat propulsion unit comprising:

an engine;

a drive shaft arranged to extend below the engine;

a drive gear disposed below the drive shaft;

a first bevel gear arranged to be meshed with the drive gear and to rotate in a first direction in accordance with rotation of the drive gear; and a second bevel gear arranged to be meshed with the drive gear and to rotate in a second direction opposite to the first direction in accordance with rotation of the drive gear;

a first shaft and a second shaft arranged to extend in a direction intersecting with the drive shaft;

a first propeller disposed on the first shaft and arranged to rotate together with the first shaft during both of forward travel and reverse travel of a boat; and a second propeller disposed on the second shaft and arranged to rotate together with the second shaft in an opposite direction of the first propeller during both of the forward travel and the reverse travel of the boat; wherein when the boat is propelled forward, the first bevel gear is engaged with the first shaft to rotate the first shaft in the first direction, and the second bevel gear is engaged with the second shaft to rotate the second shaft in the second direction; the boat propulsion unit further comprising:

a first clutch arranged to be engaged during the forward travel of the boat to transmit rotation of the first bevel gear to the first shaft, and to be engaged during the reverse travel of the boat to transmit rotation of the second bevel gear to the first shaft; and a second clutch arranged to be engaged during the forward travel and the reverse travel of the boat and to transmit rotation of the second bevel gear to the second shaft.

16. The boat propulsion unit according to claim 15, further comprising:

a third clutch arranged to be engaged during the reverse travel of the boat and to transmit rotation of the second bevel gear to the second shaft.

17. The boat propulsion unit according to claim 16, further comprising:

a reverse drive arranged to be driven when the third clutch is engaged during the reverse travel of the boat.

* * * * *